US009638017B2

(12) United States Patent
Detournay et al.

(10) Patent No.: US 9,638,017 B2
(45) Date of Patent: May 2, 2017

(54) BATCH SOLUTION MINING USING LITHOLOGICAL DISPLACEMENT OF AN EVAPORITE MINERAL STRATUM AND MINERAL DISSOLUTION WITH STATIONARY SOLVENT

(71) Applicant: SOLVAY SA, Brussels (BE)

(72) Inventors: Jean-Paul Detournay, Brussels (BE); Ronald O. Hughes, Green River, WY (US); Herve Cuche, Waterloo (BE); Matteo Paperini, Green River, WY (US); Joseph A. Vendetti, Green River, WY (US); Larry C. Refsdal, Green River, WY (US); David M. Hansen, Green River, WY (US); Todd Brichacek, Green River, WY (US); Justin T. Patterson, Mountain View, WY (US); John Kolesar, Green River, WY (US); Ryan Schmidt, Green River, WY (US); Beatrice C. Ortego, Katy, TX (US)

(73) Assignee: Solvay SA, Brussels (BE)

( * ) Notice: Subject to any disclaimer, the term of this patent is extended or adjusted under 35 U.S.C. 154(b) by 559 days.

(21) Appl. No.: 14/062,877

(22) Filed: Oct. 24, 2013

(65) Prior Publication Data

US 2016/0356139 A1 Dec. 8, 2016

Related U.S. Application Data

(60) Provisional application No. 61/718,220, filed on Oct. 25, 2012.

(51) Int. Cl.
*E21B 43/28* (2006.01)

(52) U.S. Cl.
CPC ..... *E21B 43/28* (2013.01); *E21B 43/283* (2013.01)

(58) Field of Classification Search
CPC ..... E21B 43/283; E21B 43/285; E21B 43/29
See application file for complete search history.

(56) References Cited

U.S. PATENT DOCUMENTS 2,388,009 A 10/1945 Pike
2,625,384 A 1/1953 Pike et al.
(Continued)

FOREIGN PATENT DOCUMENTS

GB 897566 A 5/1962

OTHER PUBLICATIONS

Frint, Ray; "FMC Newest Goal: Commercial Solution Mining of Trona", Sep. 1985, Engineering and Mining Journal, FMC Report, pp. 3D and pp. 26-31; 7 pgs.

*Primary Examiner* — David Bagnell
*Assistant Examiner* — Michael Goodwin
(74) *Attorney, Agent, or Firm* — Beatrice C. Ortego

(57) ABSTRACT

Batch initiation and/or exploitation phases of in situ solution mining of a mineral from an underground evaporite mineral stratum. The initiation phase may comprise a lifting step which employs a lithological displacement (lifting) of this stratum from an underlying non-evaporite stratum with application at the strata interface of a lifting hydraulic pressure greater than overburden pressure by a solvent suitable to dissolve the mineral; a soaking step for dissolution of mineral upon contact with stationary solvent, and a brine extraction step. The method may further comprise one or more exploitation phases carried out after the initiation phase. The exploitation phase may comprise a partial filing or filling step with the same solvent or different solvent than during lifting, another soaking step, and another brine
(Continued)

extraction step. The lifting, cavity partial filing/filling, and brine extraction steps are being discontinuous. The evaporite mineral stratum preferably comprises trona.

18 Claims, 3 Drawing Sheets

(56) References Cited

U.S. PATENT DOCUMENTS

| | | | | | |
|---|---|---|---|---|---|
| 2,847,202 | A | | 8/1958 | Pullen | |
| 2,919,909 | A | | 1/1960 | Rule | |
| 2,952,449 | A | | 9/1960 | Bays | |
| 3,012,764 | A | * | 12/1961 | Jacoby | E21B 43/283 299/4 |
| 3,018,095 | A | | 1/1962 | Redlinger | |
| 3,050,290 | A | | 8/1962 | Caldwell et al. | |
| 3,058,730 | A | | 10/1962 | Bays | |
| 3,064,957 | A | * | 11/1962 | Jacoby | E21B 43/283 166/271 |
| 3,086,760 | A | * | 4/1963 | Bays | E21B 43/283 166/271 |
| 3,119,655 | A | | 1/1964 | Frint et al. | |
| 3,361,540 | A | | 1/1968 | Peverley et al. | |
| 3,387,888 | A | | 6/1968 | Shock et al. | |
| 3,612,608 | A | * | 10/1971 | Manker | E21B 43/283 299/4 |
| 4,398,769 | A | * | 8/1983 | Jacoby | E21B 43/26 166/271 |
| 4,498,706 | A | | 2/1985 | Ilardi et al. | |
| 4,561,696 | A | * | 12/1985 | Graves | E21B 43/17 166/271 |
| 4,652,054 | A | | 3/1987 | Copenhafer et al. | |
| 4,815,790 | A | | 3/1989 | Rosar et al. | |
| 5,262,134 | A | | 11/1993 | Frint et al. | |
| 7,507,388 | B2 | | 3/2009 | Ceylan et al. | |
| 8,057,765 | B2 | | 11/2011 | Day et al. | |
| 2003/0029617 | A1 | | 2/2003 | Brown et al. | |
| 2011/0127825 | A1 | * | 6/2011 | Hughes | E21B 43/28 299/4 |

* cited by examiner

BATCH SOLUTION MINING USING LITHOLOGICAL DISPLACEMENT OF AN EVAPORITE MINERAL STRATUM AND MINERAL DISSOLUTION WITH STATIONARY SOLVENT

CROSS-REFERENCE TO RELATED APPLICATIONS

The present application claims priority benefit to U.S. provisional application No. 61/718,220 filed on Oct. 25, 2012, this application being herein incorporated by reference in its entirety.

STATEMENT REGARDING FEDERALLY SPONSORED RESEARCH OR DEVELOPMENT

Not applicable.

TECHNICAL FIELD OF THE INVENTION

The present invention relates to a batch method for in situ solution mining of a mineral from an underground evaporite mineral stratum using lithological displacement of this stratum from an underlying non-evaporite stratum with application of a lifting hydraulic pressure at the strata interface with a flowing solvent which is suitable to dissolve the mineral followed by dissolution of the mineral with a non-flowing solvent and extraction of a brine to the surface.

BACKGROUND OF THE INVENTION

Sodium carbonate ($Na_2CO_3$), or soda ash, is one of the largest volume alkali commodities made world wide with a total production in 2008 of 48 million tons. Sodium carbonate finds major use in the glass, chemicals, detergents, paper industries, and also in the sodium bicarbonate production industry. The main processes for sodium carbonate production are the Solvay ammonia synthetic process, the ammonium chloride process, and the trona-based processes.

Trona-based soda ash is obtained from trona ore deposits in the U.S. (southwestern Wyoming in Green River, in California near Searles Lake and Owens Lake), Turkey, China, and Kenya (at Lake Magadi) by underground mechanical mining techniques, by solution mining, or lake waters processing.

Crude trona is a mineral that may contain up to 99% sodium sesquicarbonate (generally about 70-99%). Sodium sesquicarbonate is a sodium carbonate-sodium bicarbonate double salt having the formula ($Na_2CO_3.NaHCO_3.2H_2O$) and which contains 46.90 wt. % $Na_2CO_3$, 37.17 wt. % $NaHCO_3$ and 15.93 wt. % $H_2O$. Crude trona also contains, in lesser amounts, sodium chloride (NaCl), sodium sulfate ($Na_2SO_4$), organic matter, and insolubles such as clay and shales. A typical analysis of the trona ore mined in Green River is shown in TABLE 1.

TABLE 1

| Constituent | Weight Percent |
|---|---|
| $Na_2CO_3$ | 43.2-45 |
| $NaHCO_3$ | 33.7-36 |
| $H_2O$ (crystalline and free moisture) | 15.3-15.6 |
| NaCl | 0.004-0.1 |
| $Na_2SO_4$ | 0.005-0.01 |
| Insolubles | 3.6-7.3 |

Other naturally-occurring sodium (bi)carbonate minerals from which sodium carbonate and/or bicarbonate may be produced are known as nahcolite, a mineral which contains mainly sodium bicarbonate and is essentially free of sodium carbonate and known as "wegscheiderite" (also called "decemite") of formula: $Na_2CO_3.3\ NaHCO_3$.

In the United States, trona and nahcolite are the principle source minerals for the sodium bicarbonate industry. While sodium bicarbonate can be produced by water dissolution and carbonation of mechanically mined trona ore or of soda ash produced from trona ore, sodium bicarbonate can be produced also by solution mining of nahcolite. The production of sodium bicarbonate typically includes cooling crystallization or a combination of cooling and evaporative crystallization.

The large deposits of mineral trona in the Green River Basin in southwestern Wyoming have been mechanically mined since the late 1940's and have been exploited by five separate mining operations over the intervening period. In 2007, trona-based sodium carbonate from Wyoming comprised about 90% of the total U.S. soda ash production. To recover valuable alkali products, the so-called 'monohydrate' commercial process is frequently used to produce soda ash from trona. When the trona is mechanically mined, crushed trona ore is calcined (i.e., heated) to convert sodium bicarbonate into sodium carbonate, drive off water of crystallization and form crude soda ash. The crude soda ash is then dissolved in water and the insoluble material is separated from the resulting solution. A clear solution of sodium carbonate is fed to a monohydrate crystallizer, e.g., a high temperature evaporator system generally having one or more effects (sometimes called 'evaporator-crystallizer'), where some of the water is evaporated and some of the sodium carbonate forms into sodium carbonate monohydrate crystals ($Na_2CO_3.H_2O$). The sodium carbonate monohydrate crystals are removed from the mother liquor and then dried to convert the crystals to dense soda ash. Most of the mother liquor is recycled back to the evaporator system for additional processing into sodium carbonate monohydrate crystals.

The Wyoming trona deposits are evaporites and hence form various substantially horizontal layers (or beds). The major deposits consists of 25 near horizontal beds varying from 4 feet (1.2 m) to about 36 feet (11 m) in thickness and separated by layers of shales. Depths range from 400 ft (120 m) to 3,300 ft (1,000 m). These deposits contain from about 88% to 95% sesquicarbonate, with the impurities being mainly dolomite and calcite-rich shales and shortite. Some regions of the basin contain soluble impurities, most notably halite (NaCl). These extend for about 1,000 square miles (about 2,600 $km^2$), and it is estimated that they contain over 75 billions tons of soda ash equivalent, thus providing reserves adequate for reasonably forseeable future needs.

In particular, a main trona bed (No. 17) in the Green River Basin, averaging a thickness of about 8 feet (2.4 m) to about 11 feet (3.3 m) is located from approximately 1,200 feet (about 365 m) to approximately 1,600 feet (about 488 m) below ground surface. Presently, trona from the Wyoming deposits is economically recovered mainly from the main trona bed no. 17. This main bed is located below substantially horizontal layers of sandstones, siltstones and mainly unconsolidated shales. In particular, within about 400 feet (about 122 m) above the main trona bed are layers of mainly weak, laminated green-grey shales and oil shale, interbedded with bands of trona from about 4 feet (about 1.2 m) to about 5 feet thick (about 1.5 m). Immediately below the main trona bed lie substantially horizontal layers of somewhat plastic oil shale, also interbedded with bands of trona. Both overlying and underlying shale layers contain methane gas.

The comparative tensile strengths, in pounds per square inch (psi) or kilopascals (kPa), of trona and shale in average values are substantially as follows:

Shale: 70-140 psi (482-965 kPa)

Trona: 290-560 psi (2,000-3,861 kPa)

Both the immediately overlying shale layer and the immediately underlying shale layer are substantially weaker than the main trona bed. Recovery of the main trona bed, accordingly, essentially comprises removing the only strong layer within its immediate vicinity.

Most mechanical mining operations to extract trona ore practice some form of underground ore extraction using techniques adapted from the coal and potash mining industries. A variety of different systems and mechanical mining techniques (such as longwall mining, shortwall mining, room-and-pillar mining, or various combinations) exist. Although any of these various mining techniques may be employed to mine trona ore, when a mechanical mining technique is used, nowadays it is preferably longwall mining.

All mechanical mining techniques require miners and heavy machinery to be underground to dig out and convey the ore to the surface, including sinking shafts of about 800-2,000 feet (about 240-610 meters) in depth. The cost of the mechanical mining methods for trona is high, representing as much as 40 percent of the production costs for soda ash. Furthermore, recovering trona by these methods becomes more difficult as the thickest beds (more readily accessible reserves) of trona deposits with a high quality (less contaminants) were exploited first and are now being depleted. Thus the production of sodium carbonate using the combination of mechanical mining techniques followed by the monohydrate process is becoming more expensive, as the higher quality trona deposits become depleted and labor and energy costs increase. Furthermore, development of new reserves is expensive, requiring a capital investment of as much as hundreds of million dollars to sink new mining shafts and to install related mining and safety (ventilation) equipment.

Additionally, because some shale is also removed during mechanical mining, this extracted shale must then be transported along with the trona ore to the surface refinery, removed from the product stream, and transported back into the mine, or a surface waste pond. These insoluble contaminants not only cost a great deal of money to mine, remove, and handle, they provide very little value back to the mine and refinery operator. Additionally, the crude trona is normally purified to remove or reduce impurities, primarily shale and other nonsoluble materials, before its valuable sodium content can be sold commercially as: soda ash ($Na_2CO_3$), sodium bicarbonate ($NaHCO_3$), caustic soda (NaOH), sodium sesquicarbonate ($Na_2CO_3.NaHCO_3.2H_2O$), a sodium phosphate ($Na_5P_3O_{10}$) or other sodium-containing chemicals.

Recognizing the economic and physical limitations of underground mechanical mining techniques, solution mining of trona has been long touted as an attractive alternative with the first U.S. Pat. No. 2,388,009 entitled "Solution Mining of Trona" issued to Pike in 1945. Pike discloses a method of producing soda ash from underground trona deposits in Wyoming by injecting a heated brine containing substantially more carbonate than bicarbonate which is unsaturated with respect to the trona, withdrawing the solution from the formation, removing organic matter from the solution with an adsorbent, separating the solution from the adsorbent, crystallizing, and recovering sodium sesquicarbonate from the solution, calcining the sesquicarbonate to produce soda ash, and re-injecting the mother liquor from the crystallizing step into the formation.

In its simplest form, solution mining of trona is carried out by contacting trona ore with a solvent such as water or an aqueous solution to dissolve the ore and form a liquor (also termed 'brine') containing dissolved sodium values. For contact, the water or aqueous solution is injected into a cavity of the underground formation, to allow the solution to dissolve as much water-soluble trona ore as possible, and then the resulting brine is flowed to the surface (pumped or pushed out). A portion of the brine can be used as feed material to process it into one or more sodium salts, while another portion may be re-injected for further contact with the ore.

Solution mining of trona could indeed reduce or eliminate the costs of underground mining including sinking costly mining shafts and employing miners, hoisting, crushing, calcining, dissolving, clarification, solid/liquid/vapor waste handling and environmental compliance. The numerous salt (NaCl) solution mines operating throughout the world exemplify solution mining's potential low cost and environmental impact. But ores containing sodium carbonate and sodium bicarbonate (trona, wegscheiderite) have relatively low solubility in water at room temperature when compared with other evaporite minerals, such as halite (mostly sodium chloride) and potash (mostly potassium chloride), which are mined "in situ" with solution mining techniques.

Implementing a solution mining technique to exploit sodium (bi)carbonate-containing ores like trona ore, especially those ores whose thin beds and/or deep beds of depth of greater than 2,000 ft (610 m) which are currently not economically viable via mechanical mining techniques, has proven to be quite challenging.

In 1945, Pike proposed the use of a single well comprising an outer casing and an inner casing. Hot solvent is injected through the inner casing to contact the trona bed, and the brine is withdrawn through the annulus. This method however proved unsuccessful and currently there are two approaches to trona solution mining that are being pursued.

One trona solution mining approach which is commercially used at the present time is part of an underground tailings disposal projects. Mine operators flood old workings, dissolving the pillars and recovering the dissolved sodium value. Solution mining of mine pillars was disclosed in U.S. Pat. No. 2,625,384 issued to Pike et al in 1953 entitled "Mining Operation"; it uses water as a solvent under ambient temperatures to extract trona from existing mined sections of the trona deposits. Solvay Chemicals, Inc. (SCI), known then as Tenneco Minerals was the first to begin depositing tails, from the refining process back into these mechanically mined voids left behind during normal partial extract operation. Applicants call this approach a 'hybrid' solution mining process as it takes advantage of the remnant voids and subsequent exposed surface areas of trona left behind from mechanical mining to both deposit insoluble materials and other contaminants (collectively called tailings or tails) and to recover sodium value from the aqueous solutions used to carry the tails.

Even though solution mining of remnant mechanically mined trona is one of the preferred mining methods in terms of both safety and productivity, there are several problems to be addressed, not the least of which is the resource itself. Hybrid solution mining processes are necessarily dependent upon the surface area and openings provided by mechanical mining to make them economically feasible and productive, but there is a finite amount of trona that has been previously mechanically mined. These 'hybrid' mining processes cannot exist in their present form without the necessity of prior mechanical mining in a partial extraction mode. When current trona target beds will be completely mechanically mined, the operators will eventually be forced to move into thinner beds of lower quality and to endure more rigorous mining conditions while the preferred beds are depleting and finally become exhausted.

This is where the second solution mining approach would allow the extraction of trona from less desirable beds (thin beds, poor quality beds, and/or deeper beds) which are currently less economically viable, without the negative impact of increased mining hazards and increased costs.

In this other trona solution mining approach, two or more vertical wells are drilled into the trona bed, and a low pressure connection is established by hydraulic fracturing or directional drilling.

Attempts to solution mine trona using vertical boreholes began soon after the 1940's discovery of trona in the Green River Basin in Wyoming. U.S. Pat. No. 3,050,290 entitled "Method of Recovery Sodium Values by Solution Mining of Trona" by Caldwell et al. discloses a process for solution mining of trona that suggests using a mining solution at a temperature of the order of 100-200° C. This process requires the use of recirculating a substantial portion of the mining solution removed from the formation back through the formation to maintain high temperatures of the solution. A bleed stream from the recirculated mining solution is conducted to a recovery process during each cycle and replaced by water or dilute mother liquor. U.S. Pat. No. 3,119,655 entitled "Evaporative Process for Producing Soda Ash from Trona" by Frint et al discloses a process for the recovery of soda ash from trona and recognizes that trona can be recovered by solution mining. This process includes introduction of water heated to about 130° C., and recovery of a solution from the underground formation at 90° C.

Directional drilling from the ground surface has been used to connect dual wells for solution mining bedded evaporite deposits and the production of sodium bicarbonate, potash and salt. Nahcolite solution mining utilizes directionally drilled boreholes and a hot aqueous solution comprised of dissolved soda ash, sodium bicarbonate and salt. Development of nahcolite solution mining cavities by using directionally drilled horizontal holes and vertical drill wells is described in U.S. Pat. No. 4,815,790, issued in 1989 to E. C. Rosar and R. Day, entitled "Nahcolite Solution Mining Process". The use of directional drilling for trona solution mining is described in U.S. Patent Application Pre-Grant Publication No. US 2003/0029617 entitled "Application, Method and System For Single Well Solution Mining" by N. Brown and K. Nesselrode.

However, to improve the lateral expansion of a solution mined cavity in the evaporite deposit, multiple boreholes are needed, either by a plurality of well pairs for injection and production and/or by a plurality of lateral boreholes in various configurations such as those described in U.S. Pat. No. 8,057,765, issued in November 2011 to Day et al, entitled "Methods for Constructing Underground Borehole Configurations and Related Solution Mining Methods". The cost of drilling horizontal boreholes and/or of directional drilling can add up. As a result, the benefit in cost savings sought by using solution mining may be negated by the use of expensive drilling operations to improve lateral development of cavity and/or expanding mining area.

As explained previously, a bed of trona ore typically overlays a floor made of oil shale, which is a water-insoluble incongruent material whereby the interface between these two materials forms a natural plane of weakness. If a sufficient amount of hydraulic pressure is applied at this interface, the two dissimilar substances (trona and shale) should easily separate thereby exposing a large free-surface of trona upon which a suitable solvent can be introduced for in situ solution mining.

In the late 1950's-early 1960's, hydraulic fracturing of trona has been proposed, claimed or discussed in patents as a means to connect two wells positioned in a trona bed by FMC Corporation. See for example U.S. Pat. No. 2,847,202 (1958) by Pullen, entitled "Methods for Mining Salt Using Two Wells Connected by Fluid Fracturing"; U.S. Pat. No. 2,952,449 (1960) by Bays, entitled "Method of Forming Underground Communication Between Boreholes"; U.S. Pat. No. 2,919,909 (1960) by Rule entitled "Controlled Caving For Solution Mining Methods"; U.S. Pat. No. 3,018,095 (1962) by Redlinger et al, entitled "Method of Hydraulic Fracturing in Underground Formations"; and GB 897566 (1962) by Bays entitled "Improvements in or relating to the Hydraulic Mining of Underground Mineral Deposits".

In the 1980's, a borehole trona solution mine attempt by FMC Corporation involved connecting multiple conventionally drilled vertical wells along the base of a preferred trona bed by the use of hydraulic fracturing. FMC published a report (Frint, Engineering and Mining Journal, September 1985 "FMC's Newest Goal: Commercial Solution Mining Of Trona" including "Past attempts and failures") promoting the hydraulic fracture well connection of well pairs as the new development that would commercialize trona solution mining. According to FMC's 1985 article though, the application of hydraulic fracturing for trona solution mining was found to be unreliable. Fracture communication attempts failed in some cases and in other cases gained communication between pre-drilled wells but not in the desired manner. The fracture communication project was eventually abandoned in the early 1990's.

These attempts of in situ solution mining of virgin trona in Wyoming were met with less than limited success and technologies using hydraulic fracturing to connect wells in a trona bed failed to mature.

In the field of oil and gas drilling and operation however, hydraulic fracturing is a mainstay operation, and it is estimated that more than 60% new wells in 2011 used hydraulic fracturing to extract shale gas. Such hydraulic fracturing often employs directional drilling with horizontal section within a shale formation for the purpose of opening up the formation and increasing the flow of gas therefrom to a particular single well using multi-fracking events from one horizontal borehole in the formation.

Through this technique, it has been established that fractures produced in formations should be approximately perpendicular to the axis of the least stress and that in the general state of stress underground, the three principal stresses are unequal (anisotropic conditions). Where the main stress on the formation is the stress of the overburden, these fractures tend to develop in a vertical or inverted conical direction. Horizontal fractures cannot be produced by hydraulic pressures less than the total pressure of the overburden. At sufficiently shallow depths, injection pressures equal to or slightly greater than the pressure of the overburden should favor the development of a horizontal fracture, particularly in the case where the desirable target fracture lies along a known plane of weakness between two incongruent materials such as the interface between trona and oil shale.

In fracturing between spaced wells in dense underground formations, such as mineral formations, for the purpose of removing the mineral deposits, by solution flowing between adjacent wells, the 'fracking' methods used in the oil and gas industry are not suitable to accomplish the desired results. Because the depth of the hydraulically-fractured formation is generally greater than 1,000 meters (3,280 ft), the injection pressures in oil and gas field are high, even though they are still less than the overburden pressure; this favors the formation of vertical fractures which increases permeability of the exploited shale formation. The main goal of 'fracking' methods in the oil and gas industry is to increase the permeability of shale. Overburden gradient is generally estimated to be between 0.75 psi/ft (17 kPa/m) and 1.05 psi/ft (23.8 kPa/m), thus what is called the 'fracture gradient' used in oil and gas fracking is less than the overburden gradient, preferably less than 1 psi/ft (22.6 kPa/m), preferably less than 0.95 psi/ft (21.5 kPa/m), sometimes less than 0.9 psi/ft (20.4 kPa/m). The 'fracture gradient' is a factor used to determine formation fracturing pressure as a function of well depth in units of psi/ft. For example, a fracture gradient of 0.7 psi/ft (15.8 kPa/m) in a well with a vertical depth of 2,440 m (8,000 ft) would provide a fracturing pressure of 5,600 psi (38.6 MPa).

Unlike the oil and gas exploration from shale formations where it is desirable to produce numerous vertical fractures near the center of the shale formation to recover the most oil and/or gas therefrom, in the recovery of a soluble mineral from underground evaporite formations, it is desirable to produce a single fracture substantially at the bottom of the evaporite mineral stratum and along the top of the underlying water-insoluble non-evaporite stratum and to direct the fracture to the next adjacent well along the interface between the bottom of the evaporite stratum to be removed and the top of the underlying stratum so that the soluble mineral will be dissolved from the bottom up.

Water-soluble evaporite formations, and particularly trona formations, usually consist in nearly horizontal beds of various thicknesses, underlain and overlain by water-insoluble sedimentary rocks like shale, mudstone, marlstone and siltstone. The surface of separation between the evaporite stratum and the underlying or overlying non-evaporite stratum is usually sharply defined. This surface of separation at any given point may lie substantially in a horizontal plane. In the U.S. Green River Basin, the depth of the surface of separation between the trona and oil shale strata is shallow, typically 3,000 ft (914 m) or less, preferably a depth of 2,500 ft (762 m) or less, more preferably a depth 2,000 ft (610 m) or less. At sufficiently shallow depths, injection pressures equal to or slightly greater than the pressure of the overburden should favor the development of a horizontal fracture, particularly in the case where the desirable target fracture lies along a known plane of weakness between two incongruent materials such as the interface between trona and oil shale. When the water-soluble evaporite stratum is a nearly horizontal bed underlain by water-insoluble nearly horizontal sedimentary rock, the single main fracture (interface gap) created at their interface is substantially horizontal.

The bottom-up approach for dissolving the mineral from the interface gap (fracture) created substantially at the bottom of the evaporite stratum offers a number of advantages. The less concentrated and less saturated solvent present in the gap rises to a top layer of the solvent body inside the gap due to the density gradient, and contacts the bottom of the evaporite stratum, dissolves the mineral therefrom, and as the solvent becomes more saturated, settles to a lower layer of the solvent body so that the bottom edge of the evaporite stratum is always exposed to dissolution by less concentrated solvent. The insoluble materials in the evaporite formation can settle through the solvent body to the bottom of the solution-mining cavity and deposit thereon so that only clear solutions are recovered from production wells.

A further advantage of the bottom-up approach for solution mining of mineral is that it can help minimize contact of the solvent with contaminants-rich minerals (e.g., halite) which may be found in overlying strata such as green shale strata found above a trona stratum. Since these contaminants-rich minerals are generally soluble in the same solvent as the desirable mineral, if solvent flow is allowed to occur to reach contaminated overlying layers, this would allow contaminants from these overlying layers to dissolve into the solvent, thereby "poisoning" the resulting brine and rendering it useless or, at the very least, making its further processing into valuable product(s) very expensive. Indeed, poisoning by sodium chloride from chloride-based minerals can occur during solution mining of trona, and it is suspected that the solution mining efforts by FMC in the 1980's in the Green River Basin were mothballed in the 1990's due to high NaCl contamination in the extracted brine.

SUMMARY OF THE INVENTION

The present invention thus relates to a cost effective solution mining method of an evaporite mineral stratum with creation of a mineral free-surface via lithological displacement using a lifting hydraulic pressure of an injected fluid applied at or near the interface between the evaporite stratum (e.g., trona) and an non-evaporite stratum (e.g., shale) and dissolution of mineral using a stationary solvent to create a cavity. The cavity can be solution mined using a batch mode of exploitation with a stationary solvent.

To allow for the development of a bottom-up solution mining approach of a shallow-depth evaporite mineral stratum having a parting interface with an underlying non-evaporite stratum of a different composition, Applicants have developed such lithological displacement technique comprising lifting, and separating, the evaporite stratum from the underlying stratum by application of a fluid at the strata interface using a lifting hydraulic pressure.

The lifting fluid may comprise or consist of a solvent suitable to dissolve the mineral, but not necessarily. The lifting fluid may be a fluid which has interesting properties such as a viscosity sufficient to efficiently maintain particles contained herein (such as proppant) in a well-dispersed manner so as to carry them all along the gap.

Once a mineral free-surface is hydraulically generated by such lifting step, the method may further comprise dissolving the mineral or a component of the mineral from the hydraulically-generated mineral free-surface which is in contact with a solvent to form a brine and extracting at least a portion of the brine to the ground surface. The dissolution of mineral is preferably carried out by contact of mineral free-surface with a non-moving solvent.

The present invention relates to batch methods for various phases of in situ solution mining of a mineral from an underground evaporite mineral stratum using discontinuous solvent injection applied to this stratum which is lithological displaced from an underlying non-evaporite stratum and dissolution by solvent upon contact with a stationary solvent.

The present invention is particularly applicable to in situ solution mining of a lithologically-displaced evaporite mineral stratum for the production of valuable products, such as rock salt, potash, soda ash, and/or derivatives thereof.

The evaporite mineral stratum may comprise a mineral which is soluble in a removable solvent to form a brine which can be used for the production of rock salt (NaCl), potash (KCl), soda ash, and/or derivatives thereof. The mineral may be selected from the group consisting of trona, nahcolite, wegscheiderite, shortite, northupite, pirssonite, dawsonite, sylvite, carnalite, halite, and combinations thereof. The evaporite mineral stratum preferably comprises a water-soluble mineral selected from the group consisting of trona, nahcolite, wegscheiderite, and combinations thereof, more preferably comprises trona. In such instance, the water-insoluble underlying stratum of a different composition may include oil shale or any substantially water-insoluble sedimentary rock that has a weak bond interface with the target evaporite stratum. The evaporite stratum is preferably at a shallow depth of 3,000 ft (914 m) or less, preferably of 2,500 feet (762 m) or less.

In some embodiments, the strata parting interface is preferably horizontal or near-horizontal with a dip of 5 degrees or less, but not necessarily.

A first aspect of the present invention relates to a lift-and-soak' batch technique for in situ solution mining of a mineral from an underground evaporite mineral stratum overlying a non-evaporite stratum comprising:

- a lifting step: flowing a solvent at a strata interface until a lifting hydraulic pressure is reached to lithologically displace (lift) the evaporite mineral stratum and the overlying overburden at the interface, thereby forming a gap (main fracture) between the strata and exposing a mineral free-surface;
- a soaking step: maintaining the solvent stationary (non-flowing solvent) at the lifting hydraulic pressure to dissolve mineral upon contact with the mineral free-surface in the gap and form a brine enriched in dissolved mineral and a cavity; and
- an extraction step: extracting to the surface the brine containing dissolved mineral that is generated during the soaking step.

The lift-and-soak' batch technique may be used as a solution mining initiation phase. The lifting hydraulic pressure in lift-and-soak' batch technique applied at the interface is preferably slightly greater (e.g., from about 0.01 to 50% greater) than the overburden pressure.

A second aspect of the present invention relates to batch exploitation techniques for in situ solution mining of a mineral from an underground evaporite mineral stratum. A batch exploitation phase for in situ solution mining may include a 'fill-and-soak' or a 'partial fill-and-soak' technique.

The batch exploitation technique may comprise:

- a partial filling or filling step: injecting a solvent into a mineral cavity comprising a mineral free-surface to fill the cavity with liquid and reach a target hydraulic pressure;
- a soaking step: maintaining the solvent at a target hydraulic pressure which is equal to or less than the lifting hydraulic pressure used in the lifting step (a) in the cavity to dissolve the mineral upon contact with the mineral free-surface in the cavity and form a brine enriched in dissolved mineral; and
- an extraction step: extracting to the surface the brine containing dissolved mineral that is generated during the soaking step.

In a first embodiment of the second aspect, the target hydraulic pressure may be the same lifting hydraulic pressure used in step (a) of the initiation phase; or may be an intermediate lifting hydraulic pressure between that used in step (a) and the hydrostatic head pressure. In this embodiment, the cavity will be filled with solvent during dissolution.

In a second embodiment of the second aspect, the target hydraulic pressure may be the hydrostatic head pressure. In this embodiment, the cavity will be filled with solvent during dissolution.

In a third embodiment of the second aspect, the target hydraulic pressure may be lower than hydrostatic head pressure. In this embodiment, the cavity will not be filled with solvent during dissolution. In such embodiments, the cavity is preferably self-supported by mineral rubble laying on the cavity's floor which provides mineral free face for dissolution.

One characteristic of the batch solution mining exploitation phase is that there is no continuous production of brine from a single exploited cavity.

However different steps in various exploitation phases may be carried out in a plurality of cavities which are exploited concurrently. In that way, while a partial filling or filling step may be carried out in one cavity, an extraction step may be carried out from another cavity, and a soaking step may be carried out in yet one or more other cavities. This alternating of steps would permit the generation of a continuous flow of brine provided from a plurality of mineral cavities which are exploited simultaneously in separate batch processes.

A third aspect of the present invention relates to a solution mining method using the above-mentioned 'lift-and-soak' batch technique (for initiation phase) and one or more 'fill-and-soak' batch techniques and/or one or more 'partial fill-and-soak" batch techniques (for exploitation phase). In this third aspect, the solution mining method would use a succession of exploitation phases after using an initiation phase. An example of such solution mining method may comprise the following succession of steps:

lift/soak/extract/fill/soak/extract/fill/soak/extract/ . . . partial-fill/soak/extract/partial-fill/soak/extract/ . . . etc A fourth aspect of the present invention relates to a manufacturing process for making one or more sodium-based products from an evaporite mineral stratum comprising a water-soluble mineral selected from the group consisting of trona, nahcolite, wegscheiderite, and combinations thereof, said process comprising:

- carrying out any aspect or embodiment of the method of solution mining of the evaporite stratum according to any of the various aspects/embodiments of the present invention to obtain a brine comprising sodium carbonate and/or bicarbonate, and
- passing at least a portion of said brine through one or more units selected from the group consisting a crystallizer, a reactor, and an electrodialysis unit, to form at least one sodium-based product.

A fifth aspect of the present invention relates to a sodium-based product selected from the group consisting of sodium sesquicarbonate, sodium carbonate monohydrate, sodium carbonate decahydrate, sodium carbonate heptahydrate, anhydrous sodium carbonate, sodium bicarbonate, sodium sulfite, sodium bisulfite, sodium hydroxide, and other derivatives, said product being obtained by the manufacturing process according to the present invention.

The following may apply to any of the various embodiments and/or aspects of such method, process, or product according of the present invention.

For any or all of the various aspects, the evaporite mineral stratum may comprise a mineral which dissolves in a solvent to form a brine which can be used for the production of rock salt (NaCl), potash, soda ash, and/or derivatives thereof.

The evaporite mineral stratum preferably comprises a water-soluble mineral selected from the group consisting of trona, nahcolite, wegscheiderite, and combinations thereof, more preferably comprises trona. In such instance, the underlying water-insoluble stratum of a different composition typically, but not necessarily, includes an oil shale stratum.

The evaporite stratum is preferably at a shallow depth of 3,000 ft (914 m) or less, preferably of 2,500 feet (762 m) or less.

The defined parting interface between the two strata is preferably horizontal or near-horizontal with a dip of 5 degrees or less, but not necessarily.

A particular embodiment of the present invention relates to a method of solution mining of an evaporite stratum in an underground formation containing such evaporite mineral stratum, said evaporite stratum lying immediately above a water-insoluble stratum of a different composition, said formation comprising a defined parting interface between the two strata and above which is defined an overburden up to the ground. In such embodiments, the evaporite mineral stratum preferably comprises a water-soluble mineral selected from the group consisting of trona, nahcolite, wegscheiderite, and combinations thereof, more preferably comprises trona; the defined parting interface between the two strata is horizontal or near-horizontal with a dip of 5 degrees or less; and/or the evaporite stratum is preferably at a shallow depth of 3,000 ft (914 m) or less, preferably of 2,500 feet (762 m) or less.

In such embodiments, the method comprises an initiation phase, said initiation phase comprising:

a lifting step (a), in which a first solvent is injected at the parting interface to lift the evaporite stratum at a lifting hydraulic pressure greater than the overburden pressure, thereby forming a gap at the interface and creating a mineral free-surface which comes in contact with said first solvent, wherein said first solvent comprises water or an unsaturated aqueous solution comprising sodium carbonate, sodium bicarbonate, sodium hydroxide, or combinations thereof;

a soaking step (b), in which said first solvent is maintained stationary at said lifting hydraulic pressure in the gap to contact said mineral free-surface for a time sufficient to dissolve at least a portion of said mineral into said first solvent to form a first brine and enlarging the gap to form a cavity with a new mineral free-surface, wherein said first brine comprises sodium carbonate, sodium bicarbonate, or combinations thereof; and an extraction step (c), in which at least a portion of said first brine is extracted from underground to the ground surface.

The method may further comprise an exploitation phase which may be carried out repetitively after the initiation phase. The exploitation phase may comprise a partial filing or filling step (d), a soaking step (e), and an extraction step (f), wherein in step (d), a second solvent is injected into the cavity obtained in step (b) to reach a target hydraulic pressure, wherein the second solvent comprises water or an unsaturated aqueous solution comprising sodium carbonate, sodium bicarbonate, sodium hydroxide, or combinations thereof, and wherein the components of said second solvent are the same as or different than the components of said first solvent;

wherein in step (e), said second solvent is maintained stationary at said target hydraulic pressure in the cavity to contact said new mineral free-surface for a time sufficient to dissolve at least a portion of said mineral into said second solvent to form a second brine, wherein said second brine comprises sodium carbonate, sodium bicarbonate, or combinations thereof; and wherein in step (f), at least a portion of said second brine is extracted from underground to the ground surface.

The lifting pressure applied during step (a) may be selected by using a fracture gradient which is higher than the overburden gradient. The lifting hydraulic pressure applied in step (a) may be characterized by a fracture gradient between 0.9 psi/ft (20.4 kPa/m) to 1.5 psi/ft (34 kPa/m), preferably from about 0.90 psi/ft to about 1.3 psi/ft, more preferably from about 0.95 psi/ft to about 1.1 psi/ft, most preferably from about 1 psi/ft to about 1.05 psi/ft.

The lifting hydraulic pressure during lifting step (a) may be at least 0.01% greater, or at least 0.1% greater, or at least 1% greater, or at least 3% greater, or at least 5% greater, or at least 7% greater, or at least 10% greater, than the overburden pressure at the depth of the interface. The hydraulic pressure during the lifting step may be at most 50% greater, or at most 40% greater, or at most 30% greater, or at most 20% greater, than the overburden pressure at the depth of the interface. The lifting hydraulic pressure during lifting step (a) may be from 0.01% to 50% greater (preferably from 1% to 50% greater) than the overburden pressure at the depth of the interface. The lifting hydraulic pressure preferably may be just above the pressure necessary to overcome the sum of the overburden pressure and the tensile strength of the strata interface.

The first solvent injected in step (a) may comprise an aqueous caustic solution or consists essentially of water; or may comprise or consist of a slurry comprising particles suspended in water or an aqueous solution (e.g., caustic solution).

The second solvent injected in step (d) may comprise an unsaturated aqueous solution comprising sodium carbonate, sodium bicarbonate, sodium hydroxide, or combinations thereof. The second solvent injected in step (d) may be substantially free of solid particles.

In some embodiments, the second solvent injected in step (e) may comprise at least a portion of the second brine extracted to the surface.

The first solvent injected in step (a) and/or the second solvent injected in step (d) from the ground surface to the interface may have a surface temperature at least 20° C. higher than the in situ temperature of the evaporite stratum. Alternatively, the surface temperature of the first and/or second solvent may be within +/−5° C. or within +/−3° C. of the in situ temperature of the evaporite stratum.

The dissolution of said mineral in step (b) may be for a time sufficient for the cavity created at the interface to have a width of at least 0.5 cm or at least 1 cm.

The time sufficient for dissolution in step (b) and/or step (e) is temperature dependent and may be from 5 minutes to 72 hours, preferably from 5 minutes to 24 hours, more preferably from 10 minutes to 12 hours.

The time for dissolution in step (e) may be sufficient to obtain a target TA content in the second brine of at least 8 wt %, preferably at least 10%, more preferably at least 12%, most preferably at least 15%.

In some embodiment, when the second brine reaches a target TA content (e.g., of at least 8%), at least a portion of said second brine which is not recycled to step (d) is processed to obtain at least one sodium-based product.

The steps (d) and (e) of the exploitation phase may be carried out at a target hydraulic pressure which may be the same lifting hydraulic pressure used in step (a) of the initiation phase or may be an intermediate lifting hydraulic pressure between that used in step (a) and the hydrostatic head pressure; or may be the hydrostatic head pressure. In these embodiments, the cavity will be filled with the second solvent during dissolution.

Alternatively, the steps (d) and (e) of the exploitation phase may be carried out at a target hydraulic pressure which may be lower than hydrostatic head pressure. In this embodiment, the cavity will not be filled with solvent during dissolution.

When the mineral cavity is self-supported by the presence of a layer of insoluble material (e.g., insolubles dislodged from the evaporite bed during the dissolution step (b) and/or (e) and remaining after mineral dissolution) and/or insolubles intentionally injected with the solvent during one or more lifting or filling steps such as tailings or other suitable insoluble propping material) and/or mineral rubble (fractured from the cavity ceiling), the solvent injection in step (d) and dissolution in step (e) may be carried out under a target pressure at least equal to hydrostatic head pressure.

The exploitation phase comprising steps (d) to (f) may be repeated until at least 30%, or at least 35%, or at least 40%, or even preferably at least 50%, of the mineral stratum volume lying above the formed void in step (a) is dissolved.

The exploitation phase comprising steps (d) to (f) may be repeated with at least a portion of the second brine extracted in step (f) being recycled into the second solvent injected in step (d).

For a batch solution mining exploitation phase, there is no continuous production of brine from a single exploited cavity. However a plurality of cavities may be exploited concurrently so that at least one extraction step (f) may be carried out from at least one cavity at any given time to allow continuous production of brine from several concurrent discontinuous exploitation phases.

The first solvent injection in step (a) and the first brine extraction in step (c) may be carried out via a single well. The second solvent injection in step (d) and the second brine extraction in step (f) may be carried out via a single well.

The first solvent injection and the first brine extraction may be carried out via separate wells which are in fluid communication with the initial gap created in step (a) and/or the cavity formed in the soaking step (b).

In some embodiments, the same single well may be used for solvent injection in steps (a) and (d) and also for brine extraction in steps (c) and (f).

In other embodiments, one well or a plurality of wells may be used for solvent injection in steps (a) and (d) and one or a plurality of separate wells may be used for brine extraction in steps (c) and (f).

The first solvent injection in step (a) may be carried out in a directionally drilled well which comprises at least one horizontal borehole with a downhole end which is located at or near the parting interface; and the gap in step (a) is created as an extension of said horizontal borehole when said first solvent exits the well downhole end, thereby lifting the overlying evaporite stratum at the interface.

The second solvent injection in step (d) and the second brine extraction in step (f) may be carried out via separate wells which are in fluid communication with the cavity created in the soaking step (b).

The extraction step (c) may be carried out by pulling or pushing the first brine with a pump or by decreasing the hydraulic pressure.

The extraction step (f) may be carried out by pulling or pushing the second brine with a pump or by decreasing the hydraulic pressure.

In some embodiments according to the third aspect of the present invention, the solution mining method comprises:

performing the initiation phase with steps (a)-(c);

and performing one or more exploitation phases with steps (d)-(f), in which particularly when the cavity is not self-supported, the target hydraulic pressure maintained in step (e) is the same lifting hydraulic pressure used in steps (a) and (b) of the initiation phase or is an intermediate lifting hydraulic pressure less than that used in steps (a) and (b) but greater than the hydrostatic head pressure;

particularly when the cavity is self-supported by a layer of insolubles, the target hydraulic pressure maintained in step (e) is at hydrostatic head pressure; and/or particularly when the cavity is self-supported by mineral rubble and optionally a layer of insolubles, performing one or more exploitation phases with steps (d)-(f), the target hydraulic pressure maintained in step (e) is at or below hydrostatic head pressure.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other methods for carrying out the same purposes of the present invention. It should also be realized by those skilled in the art that such equivalent constructions or methods do not depart from the spirit and scope of the invention as set forth in the appended claims.

BRIEF DESCRIPTION OF THE DRAWINGS

For a detailed description of the preferred embodiments of the invention, reference will now be made to the accompanying drawings which are provided for example and not limitation, in which:

FIG. 1*a-c* illustrate various steps in a solution mining initiation phase in a trona stratum at a trona/shale oil interface including a 'lift-and-soak' technique using two vertical wells according to the first aspect of the present invention, in which FIG. 1*a* illustrates a lifting step; FIG. 1*b* illustrates a soaking step after a lifting step; and FIG. 1*c* illustrates an extraction step;

FIG. 3*a-c* illustrate various steps in a solution mining initiation phase including a 'lift-and-soak' technique using a single well for injection and extraction according to a first aspect of the present invention, in which FIG. 3*a* illustrates the 'lifting' step with the injection of a solvent applied at a trona/shale oil interface; FIG. 3*b* illustrates the 'soaking' step with non-flowing solvent to allow trona dissolution; and FIG. 3*c* illustrates the step of brine extraction from the same single well.

On the figures, identical numbers correspond to similar references.

Figure 1A:
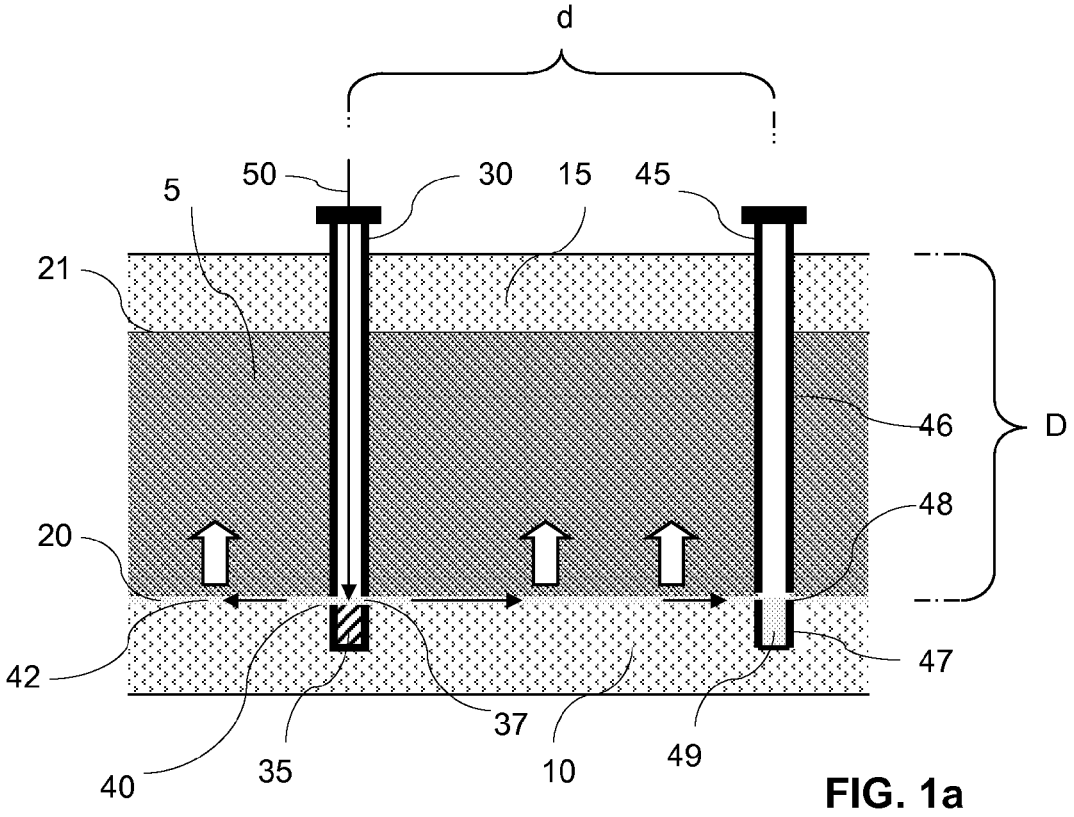

Drawings have are not to scale or proportions. Some features may have been blown out or enhanced in size to illustrate them better.

Definitions and Nomenclatures

For purposes of the present disclosure, certain terms are intended to have the following meanings.

The term 'evaporite' is intended to mean a water-soluble sedimentary rock made of, but not limited to, saline minerals such as trona, halite, nahcolite, sylvite, wegscheiderite, that result from precipitation driven by solar evaporation from aqueous brines of marine or lacustrine origin.

The term 'mined-out' in front of 'trona', 'evaporite', 'ore', or 'cavity' refers to any trona, evaporite, ore, or cavity which has been previously mined.

The term "fracture" when used herein as a verb refers to the propagation of any pre-existing (natural) fracture or fractures and the creation of any new fracture or fractures; and when used herein as a noun, refers to a fluid flow path in any portion of a formation, stratum or deposit which may be natural or hydraulically generated.

The term lithological displacement' as used herein to include a hydraulically-generated vertical displacement of an evaporite stratum (lift) at its interface with an (generally underlying) non-evaporite stratum. A "lithological displacement" may also include a lateral (horizontal) displacement of the evaporite stratum (slip), but slip is preferably avoided.

The term 'overburden' is defined as the column of material located above the target interface up to the ground surface. This overburden applies a pressure onto the interface which is identified by an overburden gradient (also called 'overburden stress', 'gravitational stress', 'lithostatic stress') in a vertical axis.

The term 'TA' or 'Total Alkali' as used herein refers to the weight percent in solution of sodium carbonate and/or sodium bicarbonate (which latter is conventionally expressed in terms of its equivalent sodium carbonate content) and is calculated as follows: TA wt %=(wt % $Na_2CO_3$)+0.631 (wt % $NaHCO_3$). For example, a solution containing 17 weight percent $Na_2CO_3$ and 4 weight percent $NaHCO_3$ would have a TA of 19.5 weight percent.

The term 'liquor' or 'brine' or 'pregnant solution' represents a solution containing solvent and dissolved mineral (such as dissolved trona). As the solvent passes through the mineral ore stratum, the solvent gets impregnated with dissolved mineral. Such solution may be unsaturated or saturated in mineral. The term 'solvent-exposed' or 'fluid-exposed' in front of 'trona', 'ore', 'mineral', "surface', 'face' refers to any trona, ore, mineral, surface, face which is in contact with a solvent or fluid.

As used herein, the term "solute" refers to a compound (e.g., mineral) which is soluble in water or an aqueous solution, unless otherwise stated in the disclosure.

As used herein, the terms "solubility", "soluble", "insoluble" as used herein refer to solubility/insolubility of a compound or solute in water or in an aqueous solution, unless otherwise stated in the disclosure.

The term "solution" as used herein refers to a composition which contains at least one solute in a solvent.

The term "slurry" refers to a composition which contains solid particles and a liquid phase.

The term "saturated solution" refers to a composition which contains a solute dissolved in a liquid phase at a concentration equal to the solubility limit of such solute under the temperature and pressure of the composition.

The term "unsaturated solution" as used herein refers to a composition which contains a dissolved solute at a concentration which is below the solubility limit of such solute under the temperature and pressure of the composition.

The term "(bi)carbonate" refers to the presence of both sodium bicarbonate and sodium carbonate in a composition, whether being in solid form (such as trona as a double salt) or being in liquid form (such as a liquor or brine). For example, a (bi)carbonate-containing stream describes a stream which contains both sodium bicarbonate and sodium carbonate.

A 'surface' parameter is a parameter characterizing a fluid, solvent and/or liquor at the ground surface (terranean location), e.g., before injection into an underground cavity or after extraction from a cavity to surface.

An in situ' parameter is a parameter characterizing a fluid, solvent and/or liquor in an underground cavity (subterranean location).

The term 'comprising' includes 'consisting essentially of" and also "consisting of".

A plurality of elements includes two or more elements.

Any reference to 'an' element is understood to encompass one or more' elements.

In the present disclosure, where an element or component is said to be included in and/or selected from a list of recited elements or components, it should be understood that in related embodiments explicitly contemplated here, the element or component can also be any one of the individual recited elements or components, or can also be selected from a group consisting of any two or more of the explicitly listed elements or components, or any element or component recited in a list of recited elements or components may be omitted from this list. Further, it should be understood that elements and/or features of a composition, a process, or a method described herein can be combined in a variety of ways without departing from the scope and disclosures of the present teachings, whether explicit or implicit herein.

The use of the singular 'a' or 'one' herein includes the plural (and vice versa) unless specifically stated otherwise.

In addition, if the term "about" is used before a quantitative value, the present teachings also include the specific quantitative value itself, unless specifically stated otherwise. As used herein, the term "about" refers to a +−10% variation from the nominal value unless specifically stated otherwise.

It should be understood that throughout this specification, when a range is described as being useful, or suitable, or the like, it is intended that any and every amount within the range, including the end points, is to be considered as having been stated. Furthermore, each numerical value should be read once as modified by the term "about" (unless already expressly so modified) and then read again as not to be so modified unless otherwise stated in context. For example, "a range of from 1 to 1.5" is to be read as indicating each and every possible number along the continuum between about 1 and about 1.5. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range.

DETAILED DESCRIPTION OF THE PREFERRED EMBODIMENTS

The following detailed description illustrates embodiments of the present invention by way of example and not necessarily by way of limitation.

It should be noted that any feature described with respect to one aspect or one embodiment is interchangeable with another aspect or embodiment unless otherwise stated.

Various aspects and embodiments of the present invention relate to batch methods for in situ solution mining of a mineral in an underground formation comprising an evaporite mineral stratum in which the mineral is soluble in a removal (liquid) solvent, such evaporite stratum lying immediately above a non-evaporite stratum of a different composition which is insoluble in such removal solvent, said underground formation having a defined parting interface between the two strata, in which a gap is initially created at the interface by lifting the evaporite stratum at the interface by application of a lifting pressure greater than the overburden pressure; then the gap is enlarged by dissolution of mineral from the solvent-exposed surface thus creating a mineral cavity and generating a brine containing dissolved mineral which is extracted from underground to the ground surface. In these batch methods, the injection of solvent and the extraction of brine are not carried out continuously in the same cavity and generally not simultaneously in the same cavity.

A batch solution mining initiation method uses, what Applicants call, a 'lift-and-soak' technique. Other batch solution mining exploitation methods use, what Applicants call, fill-and-soak' and/or 'partial fill-and-soak' techniques.

A first aspect of the present invention relates to a solution mining initiation phase, which comprises:

a)—lifting the evaporite mineral stratum via a hydraulically-generated lithological displacement at the strata interface at a lifting hydraulic pressure (greater than the overburden pressure) to form a gap with a mineral free-surface at the interface; and b)—dissolution of mineral from the mineral free-surface created by such lithological displacement at the lifting hydraulic pressure to form a brine and enlarge the gap to create a cavity;

c)—extraction of brine from underground to ground surface.

These three steps: lifting, dissolution, extraction are performed in sequence. The lifting and extraction steps are not carried out simultaneously. That is to say, when the evaporite mineral stratum is lifted, no brine is extracted, and when the brine is extracted, no solvent is injected.

According to the second aspect of the present invention, a first embodiment relates to a solution mining exploitation phase, which comprises:

d1)—flowing a second solvent into the enlarged mineral cavity created by the solution mining initiation phase according to the first aspect of the present invention and applying a target lifting pressure inside the cavity;

e1)—maintaining the second solvent stationary in the cavity at the target lifting pressure for dissolution of mineral from the new mineral free-surface upon contact with the non-flowing second solvent to form a second brine; and f)—extraction of at least a portion of the second brine loaded with dissolved mineral to the ground surface such as by pulling or pushing the brine with a pump or by decreasing the hydraulic pressure inside the cavity.

It may be especially useful to carry out such exploitation phase after the initiation phase when the cavity is nascent and the dissolution of mineral from the cavity's ceiling with a solvent-filled cavity will accelerate the enlargement of the cavity.

According to the second aspect of the present invention, a second embodiment relates to a solution mining exploitation phase, which comprises:

d2)—flowing a second solvent into a mineral cavity (which may be provided by the solution mining initiation phase according to the first aspect of the present invention or provided by one or more solution mining exploitation phases using step (e1)) according to the second aspect of the present invention) and applying hydrostatic head pressure inside the cavity;

e2)—maintaining the second solvent stationary in the cavity at hydrostatic head pressure for dissolution of mineral from the new mineral free-surface upon contact with the non-flowing second solvent to form a second brine; and f)—extraction of at least a portion of the second brine loaded with dissolved mineral to the ground surface such as by pulling or pushing the brine with a pump or by decreasing the hydraulic pressure inside the cavity.

Such exploitation phase may be useful especially when the cavity is self-supported by the presence of a layer of insoluble material which keeps the cavity's ceiling from moving downward and closing the cavity by the weight of the overburden.

According to the second aspect of the present invention, a third embodiment relates to a solution mining exploitation phase, which is similar to the second embodiment, except that the target hydraulic pressure used for mineral dissolution in a soaking step (e3) is maintained below hydrostatic head pressure, and the cavity is not filled with solvent during a partial filling step (d3). The cavity into which the solvent is injected in step (d3) may have been provided by one or more solution mining exploitation phases using step (e1) or provided by one or more solution mining exploitation phases using step (e2) according to the second aspect of the present invention. The extraction step (f) in this third embodiment may be carried out by pulling or pushing the brine with a pump.

Such exploitation phase may be useful especially when the cavity has been enlarged by a plurality of previous exploitation phases using mineral dissolution with a hydraulic pressure from the lifting pressure used in step (d1) to hydrostatic head pressure of solvent used in step (d2). For example when more than 20% of the stratum thickness of the target evaporite mineral stratum has already been solution mined, in such instance, the resulting cavity may have reached a sufficiently large horizontal unsupported span that the cavity ceiling overhead begins to slough off due to the weight of the overburden, which may eventually trigger the breakage of overhead mineral and create fractured mineral rubble which lays by gravity onto the floor of the cavity. The mineral rubble fallen into the cavity creates a support onto which the new roof of mineral cavity rests. The fractured mineral rubble inside the cavity provides fresh mineral free-surfaces for dissolution. By avoiding contact of the solvent with the cavity's ceiling for mineral dissolution, there is less risk that a contaminated layer becomes in contact with the solvent.

Similarly as with the first aspect of the present invention, the three steps (d) to (f) in the second aspect are preferably performed in sequence. The partial filling or filling step (d)

and the extraction step (f) are not carried out simultaneously to and from the cavity. That is to say, when the cavity is partially or completely filled by the injection of the second solvent, no second brine is extracted, and when the second brine is extracted, no second solvent is injected.

A third aspect of the present invention relates to an in situ solution mining method for a mineral, which comprises two batch phases:

1) the batch initiation phase (first phase) according to the first aspect of the present invention; and 2) one or more batch exploitation phases (second phase) according to the second aspect of the present invention which are carried out in the cavity initiated in the batch initiation phase according to the first aspect of the present invention.

In some embodiments of the third aspect, the solution mining method may comprise:

performing the initiation phase with steps (a)-(c);

performing one or more exploitation phases (d)-(f), in which the target hydraulic pressure in step (e) is maintained at a target lifting pressure which may be equal to or less than the lifting pressure used in step (a) and which is more than hydrostatic pressure;

performing one or more exploitation phases (d)-(f), in which the target hydraulic pressure in step (e) is maintained at hydrostatic head pressure; and/or performing one or more exploitation phases (d)-(f), in which the target hydraulic pressure in step (e) is maintained below hydrostatic head pressure.

The solution mining initiation phase (first phase) of the present invention may include forming at least one well which intersects the strata interface.

Forming a well (whether for solvent injection, for brine extraction, or for both) may include drilling a fully cased and cemented well from the surface to at least the depth of a target injection zone which is at the interface between the target block of evaporite stratum (e.g., trona bed) and the underlying stratum (e.g., oil shale).

The casing of the fully cased and cemented injection well should have a downhole section which is perforated or otherwise open at the interface to expose the target in situ injection zone. If perforated, the perforations of the well casing may be carried out solely on the lateral sides of the casing, so as to create perforations at or near the interface to allow fluid communication between the well and interface. A lateral perforating step may be carried out to allow passage of fluid in a preferential lateral way through the formed perforations.

The first solvent injection in step (a) may be carried out in a vertical well which comprises a vertical borehole section with an in situ injection zone which is located at or near the parting interface, which may comprise at least one flow opening such as casing lateral perforations.

The first solvent injection in step (a) may be carried out in a directionally drilled well which comprises at least one horizontal borehole section with an in situ injection zone which is located at or near the parting interface, which may comprise at least one flow opening, such as a downhole end opening and/or casing lateral perforations. The gap created in step (a) may become an extension of said horizontal borehole section when the first solvent exits the well downhole end opening and/or casing lateral perforations, thereby lifting the overlying stratum at the interface.

In the lifting step (a), the first solvent is injected at a strata interface (preferably injected at a specific steady volumetric flow rate) until a desired lifting hydraulic pressure is reached to lithologically displace (lift) the evaporite mineral stratum and the overlying overburden at the interface, thereby forming the gap (main fracture) between the strata and exposing a mineral free-surface.

In some embodiments, the same single well is used for solvent injection in step (a) and also for brine extraction in steps (c).

In other embodiments, one well or a plurality of wells is used for solvent injection in step (a), and a separate well or a plurality of separate wells is used for brine extraction in step (c); but both of these types of wells are preferably in fluid communication with the same cavity.

The first solvent used for the 'initiation' phase may be water or may comprise an aqueous solution comprising a desired solute (e.g., at least one component of the mineral). For a sodium (bi)carbonate-containing mineral, the desired solute is preferably selected from the group consisting of sodium sesquicarbonate, sodium carbonate, sodium bicarbonate, and mixtures thereof.

When the evaporite stratum comprises or consists of trona, the first solvent preferably comprises water or an unsaturated aqueous solution comprising sodium carbonate, sodium bicarbonate, sodium hydroxide, or combinations thereof.

The water in the first solvent may originate from natural sources of fresh water, such as from rivers or lakes, or may be a treated water, such as a water stream exiting a wastewater treatment facility.

The first solvent may be caustic or acidic or neutral.

The aqueous solution in the first solvent may contain a soluble alkali or acid compound, such as sodium hydroxide, caustic soda, any other bases, one or more acids such as sulfuric acid, citric acid, etc, or any combinations of two or more thereof.

The first solvent injected in step (a) may comprise an aqueous alkaline solution or consists essentially of water.

Water may be used preferably as the first solvent to create the gap at the interface and enlarge it quickly by mineral dissolution to form the cavity.

The first solvent injected in step (a) may comprise or consist of a slurry comprising particles suspended in water or an aqueous solution (e.g., alkaline solution). The particles may be proppant particles.

In order to maintain and/or enhance the flow-ability of the hydraulically-created gap in the mineral stratum, particulates with high compressive strength (often referred to as "proppant") may be deposited in the gap, for example, by introducing the first solvent carrying the proppant. The proppant particles are generally water-insoluble. The proppant may prevent the gap from fully closing upon the release of the hydraulic pressure for extraction in step (c), forming fluid flow channels through which the second solvent may flow in the subsequent exploitation phase. The process of placing proppant in the interface gap is referred to herein as "propping" the interface. Although it may be desirable to use proppant in maintaining fluid flow paths in the interface gap, dissolution of mineral by the first solvent will enlarge the gap over time to form a mineral cavity. As such, the proppant may be needed only during the initiation phase. But in some instances this propping may be omitted from the lifting step (a). Or the insoluble proppant may be injected later during the filling step (d).

The surface temperature of the injected first solvent can be more than 32° F. (0° C.) up to 250° F. (121° C.), preferably up to 220° F. (104° C.). The higher the injected second solvent temperature, the higher the rate of dissolution at and near the point of injection.

In preferred embodiments, the soaking step (b) may further comprise: stopping injection of said first solvent or reducing the first solvent flow rate to maintain the desired lifting hydraulic pressure during mineral dissolution. At this point, the flow of the first solvent may be stopped or at the very least reduced to a minimal flow rate so as to maintain the lifting hydraulic pressure. It is expected that there will be solvent loss to the formation as it is not liquid-tight. This minimal flow of solvent may be necessary to compensate for the bleed-off of liquid to the formation.

Various lift-and-soak' batch techniques for the initiation phase of an evaporite in situ solution mining will now be described with reference to the following drawings: FIG. 1-3.

Although FIGS. 1-3 are illustrated in the context of a trona/shale system and the application of hydraulic pressure at their underground interface, with respect to any or all embodiments of the present invention, the evaporite mineral to which the present method can be applied may be any suitable evaporite stratum containing a desirable mineral solute. The evaporite mineral stratum may comprise a mineral which dissolves in a solvent to form a brine which can be used for the production of rock salt (NaCl), potash, soda ash, and/or derivatives thereof. The evaporite mineral stratum may comprise a water-soluble mineral selected from the group consisting of trona, nahcolite, wegscheiderite, shortite, northupite, pirssonite, dawsonite, sylvite, carnalite, halite, and combinations thereof. Preferably, the evaporite mineral stratum comprises any deposit containing sodium (bi)carbonate. The evaporite mineral stratum preferably comprises a water-soluble mineral selected from the group consisting of trona, nahcolite, wegscheiderite, and combinations thereof. Most preferably, the evaporite mineral stratum comprises trona. In such instance, the underlying water-insoluble stratum of a different composition typically, but not necessarily, includes an oil shale stratum.

The overburden is defined as the column of material located above the strata interface up to the ground surface. This overburden applies a pressure onto this interface which is identified by an overburden gradient (also called 'overburden stress', 'gravitational stress', lithostatic stress') in a vertical axis.

In the drawings, a trona stratum 5 is overlying an oil shale stratum 10 and is underlying another non-evaporite stratum 15 (generally another shale stratum which may be contaminated with chloride-containing bands). There is a defined parting interface 20 between the strata 5 and 10. There is also a parting interface 21 between the strata 5 and 15. The application of hydraulic pressure is preferably carried out at the interface 20.

The trona stratum 5 may contain up to 99 wt % sodium sesquicarbonate, preferably from 25 to 98 wt % sodium sesquicarbonate, more preferably from 50 to 97 wt % sodium sesquicarbonate.

The trona stratum 5 may contain up to 1 wt % sodium chloride, preferably up to 0.8%, more preferably up to 0.5%, most preferably up to 0.2%.

The defined parting interface 20 between the strata 5 and 10 is preferably horizontal or near-horizontal, but not necessarily. The interface 20 may be characterized by a dip of 5 degrees or less; preferably with a dip of 3 degrees or less; more preferably with a dip of 1 degrees or less.

The trona/shale interface 20 may at a shallow depth 'D' of less than 3,280 ft (1,000 m) or at a depth of 3,000 ft (914 m) or less, preferably at a depth of 2,500 ft (762 m) or less, more preferably at a depth of 2,000 ft (610 m) or less. The trona/shale interface 20 may at a depth 'D' of more than 800 ft (244 m). In the Green River Basin, the trona/oil shale parting interface 20 may be at a shallow depth of from 800 to 2,500 feet (244-762 m).

In the Green River Basin, the trona stratum 5 may have a thickness of from 5 feet to 30 feet (1.5-9.1 m), or may be thinner with a thickness from 5 to 15 feet (1.5-4.6 m).

Solution Mining Initiation Phase

Figure 1B:
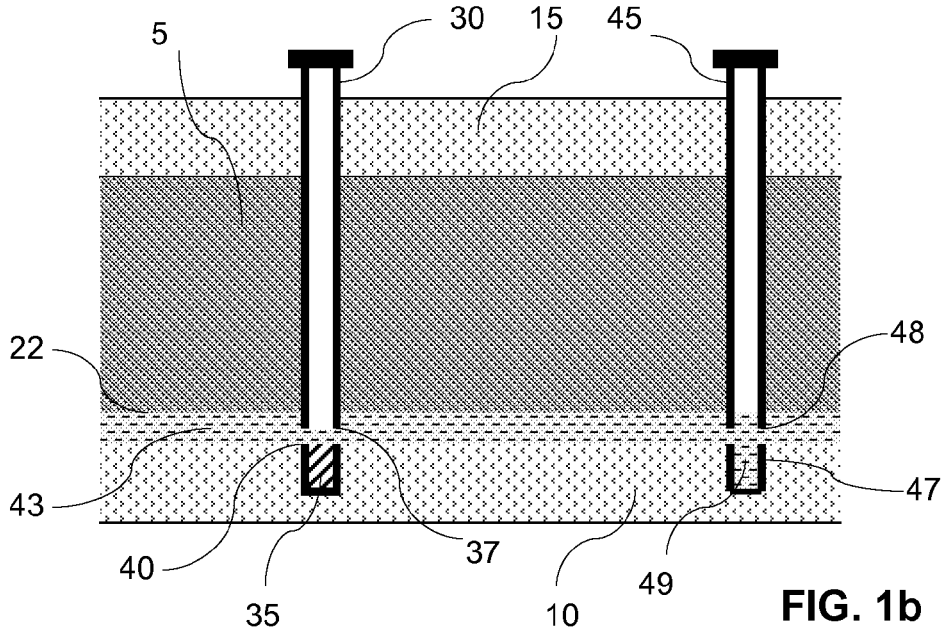
Figure 1C:
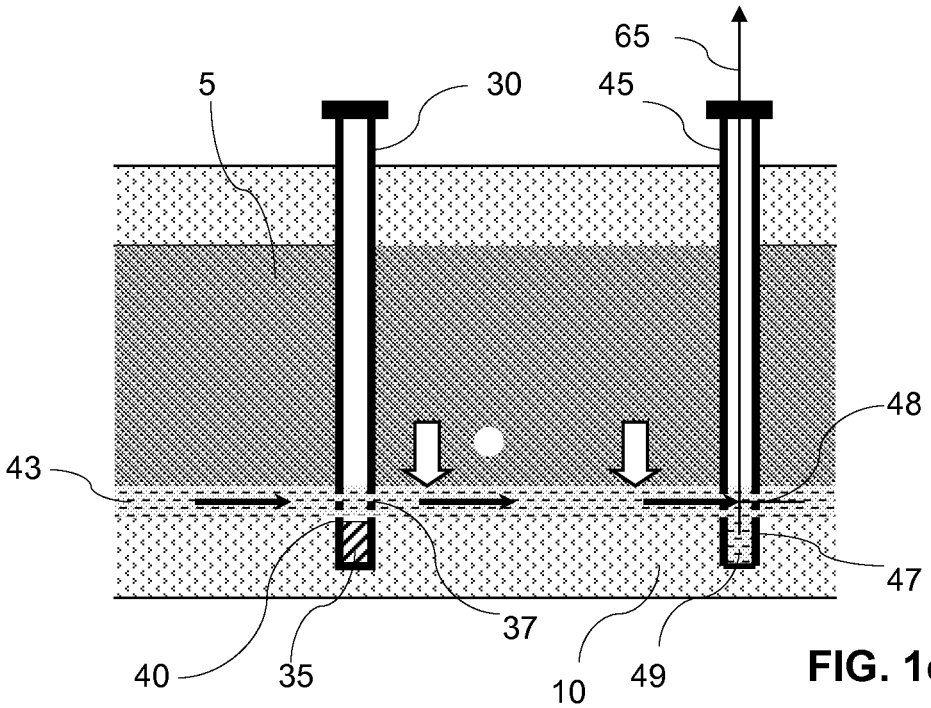
Figure 2:
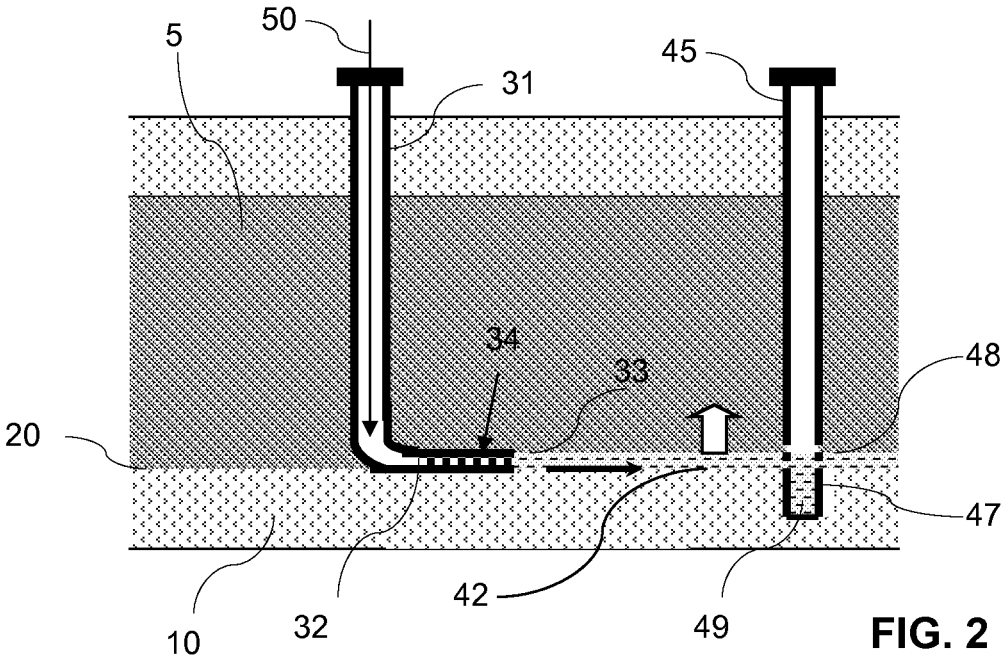
FIG. 2 illustrate an embodiment of a lithological displacement step (lifting step) in a solution mining initiation phase using a directionally drilled well with a horizontal borehole section which is located at a horizontal or near-horizontal parting trona/shale oil interface according to the first aspect of the present invention.

FIG. 1*a-c* illustrates the three main steps of the lift-and-soak' technique using at least one injection well and at least one extraction well.

For the solution mining initiation phase, the method may first comprise drilling a vertical well 30 (illustrated in FIG. 1*a-c*) from the ground down to a depth below the interface 20. The section 35 of the well 30 which is underneath the interface 20 is preferably plugged. The depth at which the bottom of well section 35 lies (where the drilling of well 30 stops) may be at least 5 feet below the depth of interface 20, preferably between 10 feet and 100 feet below the depth of interface 20, more preferably between 30 feet and 80 feet below the depth of interface 20.

The well 30 is preferably fully cemented and cased, except that it comprises an in situ injection zone 40 which is in fluid communication with the strata interface 20. The in situ injection zone 40 should allow for solvent 50 to be injected into the well 30 and to be directed at the interface 20. The in situ injection zone 40 is preferably, albeit not necessarily, designed to laterally inject the fluid in order to avoid injection of fluid in a vertical direction. The in situ injection zone 40 allows the fluid to force a path at the trona/shale interface 20 by vertically displacing the stratum 5 to create the gap 42.

The in situ injection zone 40 may comprise one or more downhole casing openings. A downhole vertical section of the vertical well 30 may have a downhole end opening which is located at or near the parting interface 20. The vertical borehole section may have perforations 37 which are at or near the interface 20. In some embodiments, these perforations 37 may be aligned with the interface 20 (such as in a row). For example, using a downhole perforating tool, perforations 37 may be cut through the casing and cement at a well circumference aligned with the interface 20 to form the in situ injection zone 40. However, it is to be noted that alignment of perforations 37 with the interface 20 is not required to provide an adequate lifting of the stratum 5 at the interface 20.

In some embodiments, the in situ injection zone 40 may be intentionally widened to form a 'pre-lift' slot between the overlying evaporite stratum and the underlying insoluble stratum, this 'pre-lift' slot providing a pre-existing "initial lifting surface" which would allow the hydraulic pressure exerted by the injected fluid to act upon this initial lifting surface preferentially in order to begin the initial separation of the two strata. The pre-lift slot may be created by directionally injecting a fluid (preferably comprising a solvent suitable to dissolve the mineral) under pressure via a rotating jet gun.

The first solvent 50 can flow through the casing of well 30 or may be injected via a conduit (not shown) all the way to the in situ injection zone 40. The in situ injection zone 40 which perforates the casing allows the first solvent 50 to force a path at the trona/shale interface 20 by lithological displacing the stratum 5 to create the gap 42.

A conduit may be inserted inside the injection well 30 to facilitate injection of solvent. The conduit may be inserted while the injection well 30 is drilled, or may be inserted after drilling is complete. The injection conduit may comprise a tubing string, where tubes are connected end-to-end to each other in a series in a somewhat seamless fashion. The injection conduit may comprise or consist of a coiled tubing, where the conduit is a seamless flexible single tubular unit. The injection conduit may be made of any suitable material, such as for example steel or any suitable polymeric material (e.g., high-density polyethylene). The injection conduit inside well 30 should be in fluid communication with the in situ solvent injection zone 40.

One or more vertical wells which may be used as production wells are drilled at a distance from the vertical well 30 used as an injection well. One vertical extraction well 45 is illustrated in FIG. 1*a-c*, although two or more extraction wells 45 may be used.

The vertical extraction well 45 may be spaced from the vertical injection well 30 by a distance 'd' of at most 1,000 meters, or at most 800 meters, or at most 600 meters. Preferred spacing 'd' between injection and extraction wells may be from 100 to 600 meters, preferably from 100 to 500 meters.

In some embodiments, the extraction well 45 may be cemented and cased from the surface down to a downhole section 47 which intersects the strata interface 20 and penetrates a portion of the oil shale stratum 10 and which is left uncased and uncemented, so that brine flowing therethrough may have contact with the walls of the section 47 of well 45. In preferred embodiments, the well 45 is cemented and cased all the way down past the interface 20 including the downhole section 47, but the well 45 is perforated where it intersects the interface 20 to provide fluid communication between the inside of the well 45 and the interface 20. Using a downhole perforating tool, perforations 48 may be cut through the casing and the cement of well 45 at or near the interface 20. As shown in FIGS. 1*b* and 1*c*, these perforations 48 would allow the first brine 65 from a cavity 43 created at the interface 20 to enter the lumen of well 45. The first brine 65 may be collected in a sump 49 (collection zone) at the downhole section 47 of the extraction well 45. When the mineral in the stratum 5 contains insoluble material which would not dissolve into the first solvent 50 during step (b), some of these insolubles may settle in the lower-depth sump 49 which would help keep the first brine 65 cleaner. In this case the brine 65 would be extracted from the perforations 48 of the casing standing above the sump 49 by using a downhole or surface pumping system (not shown).

The sump 49 (collection zone) may be created at the downhole end 47 of well 45 to facilitate the recovery of the brine from the trona mined-out cavity 43 and/or to collect insolubles (e.g., insoluble material which is left remaining after mineral dissolution at the bottom of the cavity 43 and/or insoluble material intentionally added by mine operator). The formation of the sump 49 is preferably carried out by mechanical means (such as drilling past the trona/shale interface 20). The bottom of sump 49 may have a greater depth than the bottom of the trona stratum 5. The sump 49 may be embedded at least partially or completely into the oil shale stratum 10.

A pumping system (not illustrated) may be installed so that the brine can be pumped to the surface for recovery of the alkali values. Suitable pumping system can be installed at the downhole end 47 of well 45 or at the surface end of this well. This pumping system might be an 'in-mine' system in the sump 49 (e.g., downhole pump (not shown) which would permit to push at least a portion of the first brine out from underground to the ground surface) or a 'terranean' system (e.g., a pumping system which would permit to pull at least a portion of the first brine out from underground to the ground surface). A brine return pipe (not shown) may be placed into the sump 49 or above the sump 49 in fluid communication with the terranean pumping system to allow the brine 65 to be pumped to the surface during extraction.

FIG. 1*a* illustrates the lifting step (a) in the initiation phase of the solution mining method. In FIG. 1*a*, the first solvent 50 is injected via injection zone 40 of the injection well 30 at the interface 20 between the trona stratum 5 and the underlying oil shale stratum 10 until the target lifting hydraulic pressure is reached.

During lithological displacement of the target block of trona stratum 5 in the lifting step (a), the production well 45 is capped. The injection well 30 is also capped but will allow the first solvent 50 to be injected therethrough.

The lifting hydraulic pressure applied by injecting the first solvent 50 at the interface 20 in step (a) is preferably greater than the overburden pressure. The application of hydraulic pressure by injection of solvent 50 at the interface 20 lifts the overlying trona stratum 5 and the overburden, thereby creating a main horizontal fracture (gap 42).

A fracture will open in the direction perpendicular to minimum principal stress. To propagate a fracture in an isotropic medium in the horizontal direction, the minimum principal stress must be vertical. The vertical stress at the trona/shale interface 20 coincides with the overburden pressure. It is generally prudent to select a fracture gradient for the lifting step (a) to be slightly higher than the overburden gradient to propagate a horizontal fracture initiated at the injection zone 40 along the parting interface 20.

The fracture gradient used will be slightly greater then the local lithostatic (overburden) gradient and will be more accurately estimated depending on the local underground stress field and the tensile strength of trona/shale interface. The fracture gradient used for estimating the target lifting pressure for lithological displacement is equal to or greater than 0.9 psi/ft, or equal to or greater than 0.95 psi/ft, preferably equal to or greater than 1 psi/ft. The fracture gradient used for estimating the target lifting pressure for lithological displacement may be 1.5 psi/ft or less; or 1.4 psi/ft or less; or 1.3 psi/ft or less; or 1.2 psi/ft or less; or 1.1 psi/ft or less; or even 1.05 psi/ft or less. The fracture gradient may be between 0.9 psi/ft (20.4 kPa/m) and 1.5 psi/ft (34 kPa/m); preferably between 0.90 and 1.30 psi/ft; yet more preferably between 1 and 1.25 psi/ft; most preferably between 1 and 1.10 psi/ft. The fracture gradient may alternatively be from 0.95 psi/ft to 1.2 psi/ft; or from about 0.95 psi/ft to about 1.1 psi/ft, or from about 1 psi/ft to about 1.05 psi/ft. For example, for a depth of 2,000 ft for interface 20, a minimum target hydraulic pressure of 2,000 psi may be applied at interface 20 by the injection of the fluid to lift the overburden with the stratum 5 immediately above the targeted zone to be lifted, which represents the interface 20 between the trona and the oil shale.

However, the targeted block of trona stratum 5 to be lifted is located at shallow depth where the vertical stress should be sufficiently low, and it is known to have very low tensile strength, considerably weaker than either the trona or the oil shale. The combination of both low vertical stress and a very weak horizontal interface creates very favorable conditions for the propagation of a horizontal hydraulically induced lithological displacement.

The lifting hydraulic pressure may be at least 0.01% greater, or at least 0.1% greater, or at least 1% greater, or at least 3% greater, or at least 5% greater, or at least 7% greater, or at least 10% greater, than the overburden pressure at the depth of the interface. The hydraulic pressure during the lifting step may be at most 50% greater, or at most 40% greater, or at most 30% greater, or at most 20%, than the overburden pressure at the depth of the interface. The lifting hydraulic pressure may be from 0.01% to 50% greater, or from 0.1% to 50% greater, or even from 1% to 50% greater, than the overburden pressure at the depth of the interface. The lifting hydraulic pressure preferably may be just above the pressure (e.g., about 0.01% to 1% greater) necessary to overcome the sum of the overburden pressure and the tensile strength of the strata interface.

The lifting hydraulic pressure application in step (a) of the present invention is significantly different than the commercially-available hydraulic fracturing using very high pressures in deep oil and gas formations like in shale fracturing where the intent is the creation of numerous vertical fractures in the actual rock mass at much greater depth (>4,000 ft=1,219 m) under much greater overburden pressure.

That is why the Applicants refer to the present lifting step (a) used in the solution mining initiation phase as a lithological displacement' in order to distinguish it, as a less invasive process, from the high pressure hydraulic fracturing used in oil and gas fields. The present lithological displacement' technique comprises applying a low hydraulic pressure to make a separation at a natural shallow-depth plane of weakness between a nearly horizontal bedded, soluble evaporite stratum (e.g., trona) and a dissimilar stratum (e.g., oil shale) in order to create a large mineral free-surface that a suitable solvent (e.g., water or aqueous solution) can contact to initiate in situ solution mining.

For this lithological displacement to be carried out on trona ore, the depth of the trona/shale interface is sufficiently shallow (e.g., at interface depths of less than 1,000 m) so as to encourage the development under hydraulic pressure of a main horizontal or near-horizontal fracture extending laterally away from the injection zone at this interface between the trona stratum and the underlying oil shale stratum.

Gap

The gap 42 provides a trona free-surface 22 which is mostly the bottom edge of the lifted target block of trona stratum 5. Contact with this trona free-surface 22 can be made with the first solvent 50 when the gap 42 is filled with solvent.

The formation of gap 42 in this lithological displacement may extend laterally in all directions away from the injection zone 40 for a considerable lateral distance from 30 meters (about 100 feet), up to 150 m (about 500 ft), up to 300 m (about 1,000 ft), up to 500 m (about 1,640 ft), or even up to 610 m (about 2,000 ft) away. Because it is expected that the stresses are not equal in all directions, the lateral expansion will not be even in the horizontal plane. The width of the gap 42 however would be much less than 1 cm, generally about 0.5-1 cm near the injection zone up to 0.25 cm at the extreme edge of the lateral expanse. The width of the gap 42 is highly dependent upon the flow rate of the first solvent 50 during lithological displacement.

Ideally, the lateral expanse of the gap 42 intercepts during lithological displacement the perforated downhole end of at least one extraction well 45. In this manner a fluid communication is established between the injection well 30 and the extraction well 45 as shown in FIG. 1*a*.

First Solvent

For injection of the first solvent 50, water may be used initially to create the gap 42 at the interface 20 and to enlarge the gap 42 to form the cavity 43. The injected water may be extracted by flowback into well 30 to drain the cavity 43 of liquid.

The first solvent 50 is preferably injected at a volumetric flow rate selected from about 1 to 50 barrels per minute, to allow the hydraulic pressure to rise at the in situ injection zone 40 until it reaches the lifting hydraulic pressure (estimated to be the interface depth times the fracture gradient). At this point, the flow of injected fluid may be stopped or at least reduced to a very low flow rate, but the lifting hydraulic pressure is maintained.

The first solvent 50 may comprise an aqueous caustic solution or may consist essentially of water.

The first solvent 50 injected in step (a) may comprises an unsaturated aqueous solution comprising sodium carbonate, sodium bicarbonate, sodium hydroxide, or combinations thereof.

Water may be used preferably as the first solvent 50 to create the gap 42 at the interface 20 and enlarge it quickly by mineral dissolution to form the cavity 43.

The first solvent 50 may comprise or consist of a slurry comprising particles suspended in water or an aqueous solution (e.g., caustic solution). The particles may be proppant particles.

For solution mining of trona stratum 5, the surface temperature of first solvent 50 may be more than 32° F. (0° C.) to up to 250° F. (121° C.), or up to 220° F. (104° C.). The surface temperature of first solvent 50 may be preferably between 59° F. and 194° F. (15-90° C.) or between 100° F. and 150° F. (37.8-65.6° C.), or between 122° F. and 176° F. (50-80° C.), or between 140° F. and 176° F. (60-80° C.), more preferably between 140° F. (60° C.) and 158° F. (70° C.) most preferably about 149° F. (65° C.).

The first solvent 50 may be preheated before injection.

The first solvent 50 may be preheated to a predetermined temperature to increase the solubility of one or more desired solutes present in the mineral ore.

The first solvent 50 may be injected from the ground surface to the interface 20 at a surface temperature at least 20° C. higher than the in situ temperature of the evaporite stratum.

The first solvent 50 may be injected from the ground surface to the interface at a surface temperature which is near the ambient rock temperature (the in situ temperature) at the injection depth. Alternatively, the surface temperature of the first solvent 50 may be within +/−5° C. or within +/−3° C. of the in situ temperature of the evaporite stratum. Since the in situ temperature of trona stratum 5 is estimated to be about 30-36° C. (86-96.8° F.), preferably 31-35° C. (87.8-95° F.), the surface temperature of the first solvent 50 may be between about 25 and about 41° C. (about 77-106° F.).

The first solvent 50 may be injected at a volumetric flow rate from 9 to 477 cubic meters per hour ($m^3$/hr) [42-2100 gallons per minute or 1-50 barrels per minute]; from 11 to 228 $m^3$/hr [50-1000 GPM or 1.2-23.8 BBL/min]; or from 13 to 114 $m^3$/hr (60-500 GPM or 1.4-11.9 BBL/min); or from 16 to 45 $m^3$/hr (70-200 GPM or 1.7-4.8 BBL/min); or from 20 to 25 $m^3$/hr (88-110 GPM or 2.1-2.6 BBL/min).

Soaking Step (b)

In FIG. 1*b*, the soaking step (b) may be carried out as follows: the first solvent 50 is maintained stationary in the gap 42 at the lifting hydraulic pressure to allow dissolution of trona from trona free-surface 22 into the injected first solvent 50 to form the first brine 65.

The first brine 65 contains dissolved mineral; preferably comprises sodium carbonate, sodium bicarbonate, or combinations thereof. The gap 42 initially created at the interface 20 is enlarged due to trona dissolution and forms the mineral cavity 43.

In preferred embodiments, the soaking step (b) may further comprise: stopping injection of the first solvent 50 or reducing the flow rate of the first solvent 50 to maintain the desired lifting hydraulic pressure during trona dissolution. It is expected that there will be solvent loss to the underground formation as it is not liquid-tight. Because there will be some "bleed off" to the formation, the first solvent injection from the ground surface may not be stopped in practicality, but its flow rate should be much lower during the soaking step (b) compared to the flow rate used during the lifting step (a), and may be carried out solely to maintain the lifting hydraulic pressure close to the target value selected by the mine operator. Because the solvent injection is stopped or reduced to a very low flow rate, there is little flow disturbance in the cavity 43 so that the first solvent 50 is substantially left stationary inside.

The dissolution of trona in step (b) may be for a time sufficient for the cavity 43 created at the interface 20 to have a width of at least 0.5 cm, or at least 1 cm.

The dissolution of trona in step (b) may be for a time sufficient for the resulting brine 65 to become saturated with dissolved mineral.

The time sufficient for dissolution in step (b) may be from 5 minutes to 72 hours, preferably from 5 minutes to 24 hours, more preferably from 10 minutes to 12 hours.

The time for dissolution in step (b) may be sufficient to obtain a TA content in the first brine of at least 8 wt %, preferably at least 10%, more preferably at least 12%, most preferably at least 15%. In preferred embodiments, the time for dissolution in step (b) may be sufficient to obtain a brine saturated in sodium carbonate and/or bicarbonate.

Extraction Step (c)

In FIG. 1*c*, at least a portion of the first brine 65 resulting from trona dissolution is extracted to the ground surface via well 45.

This extracted portion of the first brine 65 may be pulled or pushed to the ground surface via a pump or by reducing at least some hydraulic pressure. The brine may be extracted by flowback (release of pressure) to permit drainage of the cavity.

The extraction step (c) may be such to substantially empty the cavity 43 of brine.

The at least a portion of the first brine 65 which is extracted to the surface may have a surface temperature generally lower than the surface temperature of the first solvent 50 at the time of injection. The surface temperature in the extracted first brine 65 may be at least 3° C. lower, or at least 5° C. lower, or at least 8° C. lower, or even at least 10° C. lower, than the surface temperature of the injected first solvent 50.

However, it may be envisioned under certain circumstances that the solvent 50 may be initially injected at a surface temperature lower than the native rock temperature and allowed to warm while in situ. In this instance, at least a portion of the first brine 65 which is extracted to the surface may have a surface temperature higher than the surface temperature of the first solvent 50 at the time of injection.

Recycle of Brine and Use of First Brine

The first brine extracted to the surface may be recycled back underground to provide at least a portion of the second solvent which is used for the solution mining exploitation phase described in detail later.

The portion of the first brine which is extracted to the surface may be sent at least in part to a processing plant in which one or more mineral-derived products may be manufactured. In the case of trona mining, the mineral-derived product(s) may be soda ash, any hydrates of sodium carbonate (such as decahydrate), sodium bicarbonate, sodium sesquicarbonate, sodium sulfite, and/or other derivatives.

The extracted first brine may be stored in a vessel above ground before it may be used to provide at least a portion of the second solvent in a later exploitation phase and/or to make mineral-derived products.

Another embodiment of the lifting step (a) for the solution mining initiation phase of trona using a directionally drilled well for injection and at least one vertical well for extraction will now be described with reference to the following drawing: FIG. 2.

In FIG. 2, the method may comprise drilling a directionally drilled well 30' from the ground surface to travel more horizontally down to the depth of the interface 20. A horizontal section 32 of the well 30' is drilled intersecting the interface 20. The bottom edge of the section 32 may be underneath the interface 20. The horizontal borehole has a downhole end opening 33 which is located at or near the parting interface.

The first solvent 50 is injected in the directionally drilled well 31 and flows out of the well 31 through the in situ injection zone 40 which may comprise one or more downhole casing openings. The in situ injection zone 40 is in fluid communication with the strata interface 20.

The horizontal borehole section 32 may have a downhole end opening 33 which is located at or near the parting interface 20. The downhole end opening 33 may comprise one or more holes with a smaller diameter than the internal diameter of the section 32 and may consist of the entire downhole end of the section 32. The horizontal borehole section 32 may have, alternatively or additionally, perforations 34 which are located at or near the parting interface 20. In some embodiments, the perforations 34 may be placed along at least one generatrix 36 of the casing of the horizontal section 32, the generatrix 36 being generally aligned with the interface. However, perforations 34 do not necessarily need to be aligned with the interface 20.

it should be understood that the alignment of the casing perforations (perforations 34 for directionally-drilled shell 31) with the interface 20 is not required for adequate lifting the evaporite stratum at the interface.

Additionally, with respect to casing perforations (34, 37) for injection wells 30, 31 in FIGS. 1*a* and 2, these casing perforations may be oblong with their main axis being somewhat aligned with the interface 20. However, vertical slits or circular holes or any shaped punctures with a main axis being misaligned with the interface 20 are equally suitable so long as they are located at or near the interface 20 to permit fluid flow from these perforations to the interface 20. Since casing perforations (34, 37) should be near proximity to the interface 20 and since hydraulic pressure acts in all directions equally, even fluid injected from a vertical perforation or any shaped puncture not aligned with the interface 20 should find its way to the interface 20.

Similarly as described earlier for FIG. 1*a*, the lateral extent of the gap 42 should intersect the downhole perforated section 47 with perforations 48 of an extraction well 45.

The soaking step and extraction steps as described in relation to FIGS. 1*b* and 1*c* are also applicable here for the dissolution of mineral from the gap 42 and extraction of brine from extraction well 45.

Figures 3A, 3B, 3C:
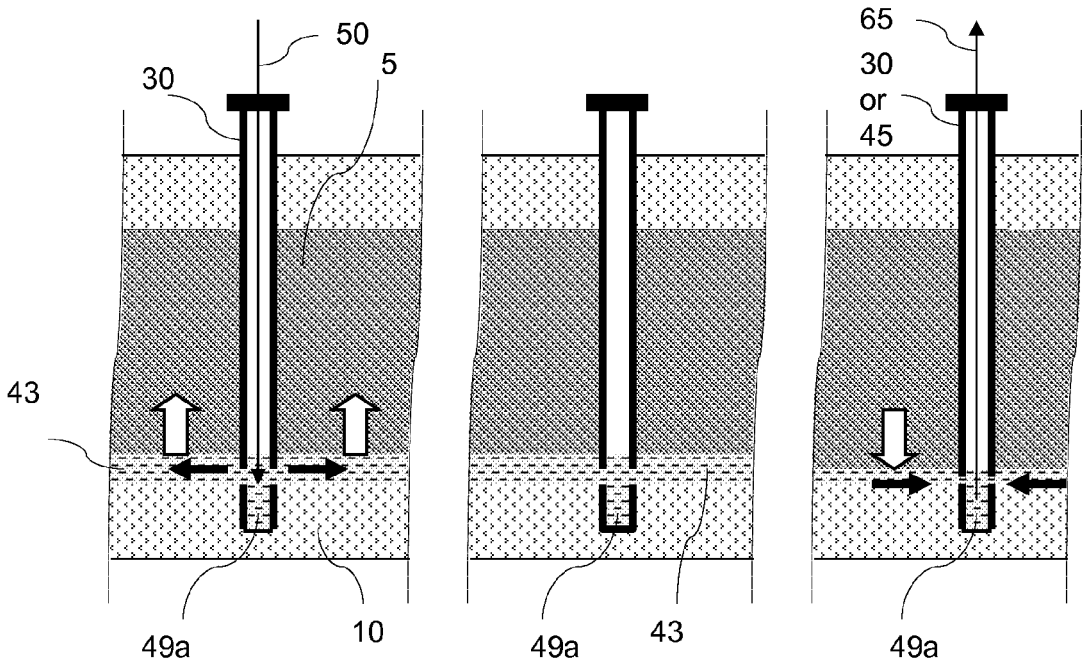

FIG. 3*a-c* illustrates the three main steps of the lift-and-soak' technique using a single vertical well which serves for both solvent injection (FIG. 3*a*) and brine extraction (FIG. 3*c*). The disclosure above in relation to FIG. 1*a-c* using two separate vertical wells which pertains to the injection of the first solvent and the soaking step with the first solvent is applicable to this embodiment.

The main difference between these two embodiments arises from the use of the single well 30 which also performs the extraction of brine in FIG. 3*c*.

The plug 35 which is used initially for the lifting step (shown in FIG. 1*a*) has been removed or drilled out in this system in order to make a brine collection zone (sump 49*a*) at the downhole end of the well 30, as shown in FIG. 3*a-c*.

Solution Mining Exploitation Phase

Once the mineral cavity is formed at the interface during the initiation phase, exploitation of the mineral by solution mining of this cavity can take place with the use of a production solvent.

Such solution mining step may be carried out in a continuous mode in which the production solvent is injected, so that the moving production solvent dissolves the mineral from the exposed mineral free-surface, while at the same time at least a portion of the resulting brine is removed to the surface.

It is also envisioned that the solution mining step may be carried out using a batch mode technique according to the second aspect of the present invention, which Applicants have termed a "partial fill-and-soak" or fill-and-soak' technique. In such case, the production solvent is first injected until the production solvent partially or completely fills the mined-out cavity and thereafter the production solvent is maintained stationary to dissolve in place the exposed mineral free-surface. Once the brine gets laden with sodium values (for example reaches at least 8% TA for trona mining), the resulting brine is removed to the surface. When the mined-out cavity is partially or completely drained, more production solvent can be injected into the cavity, and the batch technique is repeated.

Accordingly, the present invention further relates to various embodiments of exploitation phases according to the second aspect of the present invention for solution mining of the evaporite mineral stratum in the underground formation in which the evaporite mineral stratum comprises a water-soluble mineral selected from the group consisting of trona, nahcolite, wegscheiderite, shortite, northupite, pirssonite, dawsonite, sylvite, carnalite, halite, and combinations thereof; preferably selected from the group consisting of trona, nahcolite, wegscheiderite, and combinations thereof. The solution mining exploitation phase may comprise a batch fill-and-soak' or 'partial fill-and-soak' technique.

In preferred embodiments, the solution mining method comprises at least one exploitation phase, such exploitation phase comprising a pre-filling or filling step (d):

(d) injecting a second solvent into the cavity to contact the new mineral free face until a target hydraulic pressure is reached.

The components of said second solvent may be the same as or different than the components of said first solvent used in the solution mining initiation phase.

The exploitation phase further comprises a soaking step (e) and an extraction step (f):

(e) maintaining such second solvent in contact with the new mineral free-surface under said target hydraulic pressure for a time sufficient to dissolve at least a portion of said mineral from said new mineral free-surface into said second solvent to form a second brine; and (f) extracting at least a portion of said second brine to the surface.

The dissolution in step (e) generally leaves a layer of insolubles at the bottom of the solution-mined cavity, such insolubles layer providing a (porous) flow channel in the cavity for the brine to flow therethrough, and additionally providing in some instances support for the cavity ceiling to prevent the bottom of the evaporite stratum to lay on top of the underlying stratum.

Target Hydraulic Pressure in Steps (d) and (e)

The target hydraulic pressure may be the same as the lifting pressure used during step (a) in the initiation phase, or an intermediate lifting pressure which is less than the lifting pressure used during step (a) and the hydrostatic head pressure. Or the target hydraulic pressure may be equal to or lower than the hydrostatic head pressure.

In some embodiments, the dissolution of the desired solute in step (e) with the second solvent may be carried out under about the same lifting pressure used during steps (a) and (b) of the initiation phase. This hydraulic pressure may be used for example in successive batch exploitation phases carried out right after the initiation phase, because the mineral cavity created in step (b) may not be self-supported. Without applying a pressure greater than the overburden pressure, the cavity will close by weight of overburden. That is to say, when the first brine is extracted by reducing the hydraulic pressure in step (c), the overburden will lay onto the underlying layer by the force of its own weight (gravity), in such a way that a large portion of the mineral free-surface created in steps (a) and (b) will no longer be accessible to the second solvent. The injection of the second solvent thus may need to be sufficiently high to again lift the overburden and the previously-lifted target block of evaporite mineral to restore accessibility of the new mineral free-surface to the second solvent.

Several swings in hydraulic pressure up to a target lifting hydraulic pressure may be used during step (d) in successive exploitation phases and may result in the cavity to open and close at the interface. After one exploitation phase or several repetitions using lifting hydraulic pressure, the evaporite mineral stratum which is subjected with these pressure swings may start breaking up and forming a mineral rubble. This mineral rubble will function to some degree as a proppant material in the cavity which will allow the cavity to be self-supported. At that point, the dissolution in step (e) may be carried out at hydrostatic head pressure or below hydrostatic head pressure.

If a layer of insoluble and/or mineral rubble can support the cavity ceiling after the initiation phase of the solution mining method, then it may not be necessary to carry out the steps (d) and (e) in the exploitation phase using a lifting hydraulic pressure.

In other embodiments, particularly when a layer of insolubles and/or mineral rubble can support the cavity ceiling, the dissolution in step (e) may be carried out at hydrostatic head pressure (at the depth at which the solution-mined cavity is enlarged), in which the cavity is filled with solvent. The hydrostatic head pressure may be used for example in successive batch exploitation phases carried out when the mineral cavity created by several rounds of dissolution is now self-supported without having to apply a hydraulic pressure greater than the overburden pressure. A layer of insolubles left at the bottom of the cavity after several rounds of dissolution. In this instance, step (e) for solution mining of trona uses this layer of insoluble rock that is deposited in the mined-out cavity by trona dissolution. This layer of insoluble separates the floor and ceiling of the mined-out cavity, while mechanically supporting the cavity ceiling and maintaining the mineral free-surface on the cavity ceiling accessible to the solvent. By flooding the cavity, the second solvent contacts the cavity ceiling and, upon contact with the mineral, dissolves it. Such insoluble layer gets thicker as more and more of the trona from the cavity ceiling gets dissolved, and provides, through its porosity, a channel through which the second (production) solvent can pass through.

In alternate embodiments, particularly when the cavity is self-supported by mineral rubble fractured from the cavity ceiling and also by a layer of water insoluble material, the dissolution in step (e) may be carried out at a hydraulic pressure below hydrostatic head pressure. This is preferably done when the development of the mined-out cavity is mature, that is to say, when the mineral cavity created by several rounds of dissolution is now self-supported without having to apply a hydraulic pressure greater than the overburden pressure to keep it open. Due to too high overburden weight on an unsupported roof span of the mineral cavity, blocks of mineral rubbles got fractured and now lay in the void of the mineral cavity. In this instance, the cavity not only contains a layer of insolubles but also mineral rubbles which now support the new cavity ceiling. In this situation, it is not necessary to flood the cavity with the second solvent to access the cavity ceiling's mineral free-surface, because the mineral rubbles now inside the cavity provide plenty of mineral free-surfaces for the second solvent to contact and dissolve to form the second brine.

Stopping Solvent Injection

In preferred embodiments, the soaking step (e) may further comprise: stopping injection of the second solvent or reducing the flow rate of the second solvent to maintain the target hydraulic pressure in the cavity, such target hydraulic pressure being the same or preferably lower than that used in step (b) during dissolution in the solution mining initiation phase. At this point, the flow of the second may be stopped or, at the very least, reduced to a minimal flow rate so as to maintain the target hydraulic pressure. It is expected that there will be solvent loss to the underground formation as it is not liquid-tight. Because there will be some "bleed off" to the formation, the second solvent injection from the ground surface may not be stopped in practicality, but its flow rate should be much lower during the soaking step (e) compared to its flow rate during the partial-filling or filling step (d), and be carried out solely to maintain the hydraulic pressure to the target value selected by the mine operator. Because the second solvent injection is stopped or reduced to a very low flow rate, there is little flow disturbance in the cavity 43 so that the second solvent is substantially left stationary inside it.

Second Solvent

The second solvent injected in step (d) and used for mineral dissolution in step (e) (sometime called 'production' solvent) may be water or may comprise an aqueous solution comprising a desired solute (e.g., at least one component of the mineral). The desired solute is preferably selected from the group consisting of sodium sesquicarbonate, sodium carbonate, sodium bicarbonate, and mixtures thereof, and the second solvent may consist of water or may comprise an aqueous solution comprising sodium carbonate, sodium bicarbonate, sodium hydroxide, or combinations thereof.

The second solvent may comprise at least in part an aqueous solution which is unsaturated in the desired solute. For example in solution mining of trona, the second solvent may comprise a brine which is unsaturated in sodium carbonate and which may be recycled from the same solution-mined target trona stratum and/or from another solution-mined trona stratum which may be adjacent to or underneath or above the target trona stratum.

The water in the second solvent may originate from natural sources of fresh water, such as from rivers or lakes, or may be a treated water, such as a water stream exiting a wastewater treatment facility.

The second solvent may be caustic or acidic or neutral. The aqueous solution in the second solvent may contain a soluble alkali or acid compound, such as sodium hydroxide, calcium hydroxide, or any other bases, one or more acids such as sulfuric acid, hydrochloric acid, citric acid, etc, or any combinations of two or more thereof.

The second solvent injected in step (e) is preferably substantially free of solid particles.

In the case of trona stratum, the second solvent may be an aqueous solution containing a base (such as NaOH), or other compound that can enhance the dissolution of trona in the solvent and/or convert sodium bicarbonate to sodium carbonate in situ.

The second solvent employed in the in-situ trona solution mining step may comprise or may consist essentially of a weak caustic solution for such solution may have one or more of the following advantages. The dissolution of sodium values with weak caustic solution is more effective, thus requiring less contact time with the trona ore. The use of the weak caustic solution also eliminates the 'bicarb blinding' effect, as it facilitates the in situ conversion of sodium bicarbonate to carbonate (as opposed to performing the conversion ex situ on the surface after extraction). It also allows more dissolution of sodium bicarbonate than would normally be dissolved with water alone, thus providing a boost in production rate. It may further leave in the mined-out cavity an insoluble carbonate such as calcium carbonate which may be useful during the mining operation.

It should be noted that the composition of the second solvent may be modified during the course of the trona solution mining operation. For example, water as second solvent may be used to initially and quickly enlarge the cavity at the strata interface, while sodium hydroxide may be added to the second solvent in a later exploitation phase in order to promote for example the conversion of sodium bicarbonate to carbonate, hence resulting in greater extraction of desired alkali values from the trona stratum.

The second solvent injected in step (e) may comprise at least a portion of the second brine extracted to the surface in step (f).

For the injection step (d), the second solvent may be preheated to a predetermined temperature to increase the solubility of one or more desired solutes present in the mineral ore.

The second solvent may be injected in step (e) from the ground surface to the interface at a surface temperature at least 20° C. higher than the in situ temperature of the mineral stratum.

Alternatively, the second solvent may be injected from the ground surface to the interface at a surface temperature which is near the ambient rock temperature (the in situ temperature) at the injection depth. The surface temperature of the second solvent may be within +/−5° C. or within +/−3° C. of the in situ temperature of the target block of evaporite stratum. The in situ temperature of a trona stratum is estimated to be about 30-36° C. (86-96.8° F.), preferably 31-35° C. (87.8-95° F.).

The temperatures of the injected second solvent can be more than 32° F. (0° C.) up to 250° F. (121° C.), preferably up to 220° F. (104° C.). The second solvent temperature may be between 104 and 176° F. (40-80° C.), or between 140 and 176° F. (60-80° C.), or between 100 and 150° F. (37.8-65.6°

C.). The higher the second solvent temperature, the higher the rate of dissolution at and near the point of solvent injection.

For trona mining, the temperature of the second solvent may be between 59° F. and 194° F. (15-90° C.) or between 100° F. and 150° F. (37.8-65.6° C.), or between 122° F. and 176° F. (50-80° C.), or between 140° F. and 176° F. (60-80° C.), more preferably between 60° C. (140 F) and 70° C. (158° F.), most preferably about 65° C. (149° F.).

The flow of second solvent may depend on the size of the cavity, such as the length of its flow path inside the cavity, the desired time of contact with ore to dissolve the mineral from the free face, as well as the stage of cavity development whether it be nascent for ongoing formation or mature for ongoing production.

For example, the second solvent volumetric flow rate in well 30 may vary from from about 1 to 50 barrels per minute (or from about 9.5 $m^3$/hr to about 477 $m^3$/hr); or from about 2.1 BBL/min to about 31.4 BBL/min (or from 20 $m^3$/hr to 300 $m^3$/hr). In some embodiments, the injected fluid flow rate in well 30 may vary from 11 to 228 $m^3$/hr [50-1000 GPM or 1.2-23.8 BBL/min]; or from 13 to 114 $m^3$/hr (60-500 GPM or 1.4-11.9 BBL/min); or from 16 to 45 $m^3$/hr (70-200 GPM or 1.7-4.8 BBL/min); or from 20 to 25 $m^3$/hr (88-110 GPM or 2.1-2.6 BBL/min).

Second Brine

The second solvent temperature generally changes from its point of injection as it gets exposed to trona. Because the second solvent temperature is generally higher than the in situ temperature of the mineral stratum, the second brine loses some heat as it flows through the mined cavity until the brine gets extracted via an extraction well.

The second brine extracted to the surface in step (f) may have a surface temperature generally lower than the surface temperature of the second solvent at the time of injection in step (d). The surface temperature in the extracted second brine may be at least 3° C. lower, or at least 5° C. lower, or at least 8° C. lower, or even at least 10° C. lower, than the surface temperature of the injected second solvent.

It is also conceivable that some circumstances may require the injection temperature to be lower than the native rock in situ temperature. In such instance, the second brine extracted to the surface in step (f) may have a surface temperature greater than the surface temperature of the second solvent at the time of injection in step (d).

The second brine at the end of step (e) and which is extracted at the surface in step (f) may be saturated in sodium carbonate or may be unsaturated in sodium carbonate.

The time for dissolution in step (e) may be sufficient to obtain a target TA content in the second brine of at least 8 wt %, preferably at least 10%, more preferably at least 12%, most preferably at least 15%. The time for dissolution in step (e) may be sufficient for the second brine to be saturated in sodium carbonate.

The dissolution of trona in step (e) may be for a time sufficient for the brine to become saturated with dissolved mineral.

A portion of such extracted second brine may be processed for recovery of the sodium values while another portion may be re-injected in step (d).

The extracted brine may be stored in a vessel above ground before it may be used to provide at least a portion of the second solvent to be re-injected into the cavity in step (d) and/or to make mineral-derived products.

When the second brine has a target TA content (e.g., at least 8% TA, preferably at least 15% TA), at least a portion of the extracted second brine which is not recycled to step (d) may be processed to obtain at least one product derived from the mineral such as a sodium-based product like soda ash, sodium bicarbonate, any sodium carbonate hydrate (e.g., monohydrate, decahydrate), sodium sesquicarbonate, sodium sulfite, sodium hydroxide, and/or other soda-ash derivatives.

It is envisioned that brine aliquots may be analyzed continuously or intermittently during dissolution for desired solute content as well as for contaminant levels to determine the extent of dissolution. For example, in the case of the trona solution mining, brine aliquots may be analyzed for TA content and contaminants content such as sodium chloride and/or sodium sulfate.

This collection of data may be used by the mine operator to decide when to stop exploitation of the mineral cavity altogether. For example, once the TA content reaches a targeted value, brine extraction may be initiated for a batch mode or less brine is recycled to the cavity. When rising contents in chloride or other contaminants are observed in successive brine aliquots over time in continuous mode or from successive exploitation batch operations of the same cavity, this observation may be used by the mine operator as an indication that the solvent is making contact with a contaminants-containing layer such as a halite band and that the solution-mined cavity is approaching the roof of the mineral stratum.

Trona dissolution may be carried out until the second brine extracted to the surface contains exceeds a maximum allowable contamination level of NaCl, in which case it may be decided to stop exploitation of the cavity.

Repetition of Exploitation Phases

The exploitation phase comprising steps (d) to (f) may be repeated until at least 30%, or at least 35%, or at least 40%, or even at least 50%, of the mineral stratum volume lying above the interface gap initially formed in step (a) is dissolved.

The exploitation phase comprising steps (d) to (f) may be repeated with at least a portion of the second brine extracted in step (f) being recycled into the second solvent injected in step (d).

The exploitation phase comprising steps (d) to (f) may be repeated until the second brine extracted to the surface contains more than 0.2 wt % NaCl, or more than 0.5 wt % NaCl, or more than 0.7 wt % NaCl, or more than 0.9 wt % NaCl, or even more than 1 wt % NaCl. Once the NaCl content reaches a maximum allowable contamination level, the mine operator may decide to stop exploitation of the mined-out mineral cavity.

Injection of Insoluble Matter

In some embodiments, injection of insoluble materials (such as tailings or other suitable insoluble propping material) may be carried out concurrently with the first solvent during the lifting step (a) in the initiation phase and/or with the second solvent during the partial filling or filling step (d) in at least one exploitation phase according to the present invention. The injection of insoluble materials may be periodic (or intermittent or continuous) or a one-time occurrence.

During the lifting step, the injection of insoluble materials may comprise: mixing a specified amount of insoluble material with the lifting fluid and injecting the combined mixture directly into the interface to place the insoluble materials inside the formed gap. Deposits of insoluble materials (such as proppant) may be employed to maintain open the gap formed after lifting.

During a dissolution step, the injection of insoluble materials may comprise: mixing a specified amount of insoluble material with the solvent and injecting the combined mixture directly into the nascent or enlarged gap (cavity).

Such injection of insoluble materials may form islands of insoluble material that would shift the fluid/solvent flow to fresh mineral surface (e.g., trona) thus changing flow paths through damming effects and/or would form some support for any possibility of downward-moving cavity ceiling. In this manner, a support system of insoluble material may be constructed to halt the ceiling movement to a desired point while flow channels created by dissolution of the solute in the mineral region surrounding the insoluble material would allow for movement of the brine through this region of the mineral ore. Deposits of insoluble materials (such as tailings) may also be employed to block certain flow pathways, especially those which may short-circuit passing over (or bypass) fresh mineral ore, such as observed with the phenomenon of 'channeling'. The deposits of insoluble materials may also act to form a barrier from the shale floor and contaminants potentially falling from the upper areas of the trona stratum, keeping the solvent from contamination by an overlying contaminant-containing layer.

For trona solution mining, the insoluble material in the injected first and/or second solvent may include tailings or other suitable insoluble propping material. Tailings in trona processing represent a water-insoluble matter recovered after a mechanically-mined trona is dissolved (generally after being calcined) in a surface refinery. During the mechanical mining of a trona stratum, some portions of the underlying floor and overlying roof rock which contain oil shale, mudstone, and claystone, as well as interbebded material, get extracted concurrently with the trona. The resulting mechanically-mined trona feedstock which is sent to the surface refinery may range in purity from a low of 75 percent to a high of nearly 95 percent trona. The surface refinery dissolves this feedstock (generally after a calcination step) in water or an aqueous medium to recover alkali values, and the portion which is non-soluble, e.g., the oil shale, mudstone, claystone, and interbedded material, is referred to as 'isols' or 'tailings'. After trona dissolution, the tailings are separated from the sodium carbonate-containing liquor by a solid/liquid separation system.

Injection of a Blanket Medium

In some embodiments of the present invention, a blanket medium which may be in gaseous form (such as comprising air, $CO_2$, methane, nitrogen, or any suitable gas which is inert under mining conditions) or in a liquid form (which is less dense than the solvent and brine, for example, a hydrocarbon liquid such as diesel or gasoline or gas oil) may be injected into the mineral cavity. This blanket injection allows the cavity enlargement to be carried out under hydraulic pressure equal to or less than hydrostatic head pressure which is determined by the depth of the targeted evaporite stratum, as a blanket forms at the ceiling of the cavity. In this manner, the blanket protects the mineral ceiling from dissolving and forces the dissolution in the horizontal direction rather than vertical. The blanket may serve to separate solvent from contaminated material in the cavity ceiling during the final stages of mineral extraction. This technique is particularly suitable for a mature mined-out cavity when the cavity contains sufficient mineral free-surfaces (e.g., fallen mineral rubble) other than the cavity mineral ceiling.

In Situ Gas Release

For any or all embodiments of the present invention, some underground gas may be released from the underlying stratum or when part of the overburden susceptible to gravitational loading and crushing cracks and falls into the cavity, and gas may be released from the overlying stratum. When the underlying and/or overlying non-evaporite strata comprise oil shale, this released underground gas may contain methane. Indeed, in the case of trona mining, even though the trona itself contains very little carbonaceous material and therefore liberates very little methane, the underlying and overlying methane-bearing oil shale strata may liberate methane during lithological displacement and/or during solution mining. When such underground gas release occurs during lithological displacement, purges of the released gas may be performed periodically to remove the gas and relieve pressure so as to prevent methane gas buildup and/or to minimize safety concerns. It is recommended to stop injection downhole during such gas purge. Purge of released gas may be effected by passage to the surface via the well 30 used for injection. Alternatively, the purge of released gas may be effected by one or more secondary purge wells (not shown in figures). It is also conceived that much of the released gas may dissolve in the lifting fluid and/or production solvent and in which case dissolved gas may leave the liquid freely under low pressure conditions at the surface. This recovered gas is likely to have a high thermal energy content that may be used as a fuel for one or more processing operations (such as providing heat and/or steam for brine evaporation, crystallization, reaction, drying of product(s), . . . in a surface refinery) and/or for mining purposes.

Recovery of Alkali Values and Products Obtained

In another aspect, the present invention relates to a manufacturing process for making one or more sodium-based products from an evaporite mineral stratum comprising a water-soluble mineral selected from the group consisting of trona, nahcolite, wegscheiderite, and combinations thereof, said process comprising:

carrying out the method of solution mining of the evaporite stratum according to any of the various aspects/embodiments of the present invention to obtain a brine comprising sodium carbonate and/or bicarbonate, and passing at least a portion of said brine through one or more units selected from the group consisting a crystallizer, a reactor, and an electrodialysis unit, to form at least one sodium-based product.

In trona solution mining, the brine extracted to the surface may be used to recover alkali values.

Examples of suitable recovery of sodium values such as soda ash, sodium sesquicarbonate, sodium carbonate decahydrate, sodium bicarbonate, and/or any other sodium-based chemicals from a solution-mined brine can be found in the disclosures of U.S. Pat. No. 3,119,655 by Frint et al; U.S. Pat. No. 3,050,290 by Caldwell et al; U.S. Pat. No. 3,361,540 by Peverley et al; U.S. Pat. No. 5,262,134 by Frint et al.; and U.S. Pat. No. 7,507,388 by Ceylan et al., and these disclosures are thus incorporated by reference in the present application.

Another example of recovery of sodium values is the production of sodium hydroxide from a solution-mined brine. U.S. Pat. No. 4,652,054 to Copenhafer et al. discloses a solution mining process of a subterranean trona ore deposit with electrodialytically-prepared aqueous sodium hydroxide in a three zone cell in which soda ash is recovered from the withdrawn mining solution. U.S. Pat. No. 4,498,706 to Ilardi et al. discloses the use of electrodialysis unit co-products, hydrogen chloride and sodium hydroxide, as separate aqueous solvents in an integrated solution mining process for recovering soda ash. The electrodialytically-produced aqueous sodium hydroxide is utilized as the primary solution mining solvent and the co-produced aqueous hydrogen chloride is used to solution-mine NaCl-contaminated ore deposits to recover a brine feed for the electrodialysis unit operation. These patents are hereby incorporated by reference for their teachings concerning solution mining with an aqueous solution of an alkali, such as sodium hydroxide and concerning the making of a sodium hydroxide-containing aqueous solvent via electrodialysis.

The sodium-based products may be sodium sesquicarbonate, sodium carbonate monohydrate, sodium carbonate decahydrate, sodium carbonate heptahydrate, anhydrous sodium carbonate, sodium bicarbonate, sodium sulfite, sodium bisulfite, sodium hydroxide, and/or other derivatives.

The process may comprise: passing at least a portion of the brine comprising sodium carbonate and/or bicarbonate:

- through a sodium sesquicarbonate crystallizer under crystallization promoting conditions to form sodium sesquicarbonate crystals;
- through a sodium carbonate monohydrate crystallizer under crystallization promoting conditions to form sodium carbonate monohydrate crystals;
- through a sodium carbonate crystallizer under crystallization promoting conditions to form anhydrous sodium carbonate crystals;
- through a sodium carbonate hydrate crystallizer under crystallization promoting conditions to form crystals of sodium carbonate decahydrate or heptahydrate;
- to a sodium sulfite plant where sodium carbonate is reacted with sulfur dioxide to form a sodium sulfite-containing stream which is fed through a sodium sulfite crystallizer under crystallization promoting conditions suitable to form sodium sulfite crystals; and/or
- through a sodium bicarbonate reactor/crystallizer under crystallization promoting conditions comprising passing carbon dioxide to form sodium bicarbonate crystals.

In any embodiment of the present invention, the method may further include passing at least a portion of the brine through one or more electrodialysis units to form a sodium hydroxide-containing solution. This sodium hydroxide-containing solution may provide at least a part of the lifting fluid to be injected into the gap for the lifting step and/or may provide at least a part of the production solvent to be injected into the cavity for the dissolution step.

In any embodiment of the present invention, the process may further comprise pre-treating and/or enriching with a solid mineral and/or purifying (impurities removal) the extracted brine before making such product.

The present invention further relates to a sodium-based product obtained by the manufacturing process according to the present invention, said product being selected from the group consisting of sodium sesquicarbonate, sodium carbonate monohydrate, sodium carbonate decahydrate, sodium carbonate heptahydrate, anhydrous sodium carbonate, sodium bicarbonate, sodium sulfite, sodium bisulfite, sodium hydroxide, and other derivatives.

Pre-Treatment of Brine Before Use or/and Recycle

The pretreatment may be carried out on the first brine and/or the second brine. Hereinafter in this paragraph concerning the pre-treatment of brine, any mention of brine means either of the first and second brines or any combinations thereof.

In some embodiments, the method may further comprise pre-treating at least one portion of a brine comprising sodium bicarbonate which is extracted from the underground to the ground surface.

The method may comprise pre-treating a portion of the extracted brine when such brine comprises sodium bicarbonate (preferably more than 3.5 wt %) before it is used to recover alkali values. The pre-treating may be carried out on at least a part of the extracted brine prior to being passed to an electrodialysis unit, a crystallizer, and/or a reactor.

The method may comprise pre-treating a portion of the extracted brine when such brine comprises sodium bicarbonate (preferably more than 3.5 wt %) before it is recycled to the cavity for further mineral dissolution.

The pre-treating may convert some of the sodium bicarbonate to sodium carbonate to achieve a sodium bicarbonate concentration in the pretreated brine below 3.5% by weight, preferably below 2% by weight, more preferably below 1% by weight, before being further subjected to a crystallization step or before being recycled at least in part to the cavity. The pretreatment of the brine may comprise contacting at least a portion of said brine with steam, and/or the pretreatment of the brine may comprise reacting the sodium bicarbonate in the brine with sodium hydroxide or another base such as calcium hydroxide.

The pre-treating may additionally or alternatively include adjusting the temperature and/or pressure of at least a portion of the extracted brine before recovering alkali values therefrom and/or before recycling into the cavity.

Forming Enriched Brine with Solid Mineral

In this paragraph concerning the formation of an enriched brine, any mention of brine means either of the first and second brines or any combinations thereof.

In some embodiments, the method may further comprise adding solid mineral (such as mechanically-mined solid virgin trona or calcined trona) to at least a portion of the extracted brine which is not recycled to the cavity prior to being passed to a process unit (such as crystallizer and/or reactor) to make one or more valuable mineral-derived products (e.g., sodium-based products). The addition of solid mineral to the solution-mined brine may be carried out on at least a part of the brine after but preferably prior to the pre-treatment step as described earlier.

For brines obtained from solution mining of trona, the method may include, after extracting at least a portion of the brine to the surface, at least one of the following steps:

- adding solid virgin trona and/or calcined trona to the extracted brine portion to increase the content in total sodium carbonate and to form an enriched brine containing at least 20% by weight of sodium carbonate;
- optionally, pre-treating such enriched brine; and
- recovering at least one alkali value, for example passing such enriched brine to an electrodialysis unit, a crystallizer, and/or a reactor in which at least one sodium-based product is produced.

Removal of Impurities

In this paragraph concerning the removal of one or more impurities, any mention of brine means either of the first and second brines or any combinations thereof.

In some embodiments, the method may further comprise removing at least a portion of undesirable solutes from at least a portion of the brine which is used to recover valuable products (such as alkali values) to purify the brine prior to being passed to a process unit (such as electrodialysis unit, crystallizer and/or reactor). Such removal may include removal of water-soluble and/or colloidal organics for example via carbon adsorption and/or filtration.

In embodiments for trona solution mining, the method may further comprise removing insoluble material from at least a portion of the brine which is used to recover alkali values, as some of the insoluble material may have precipitated once the brine is extracted to the surface and/or may have been carried from underground to above ground. Such removal may include sedimentation and/or filtration prior to being passed to a crystallizer and/or reactor to make sodium values.

The present invention having been generally described, the following Examples are given as particular embodiments of the invention and to demonstrate the practice and advantages thereof. It is understood that the examples are given by way of illustration and is not intended to limit the specification or the claims to follow in any manner.

EXAMPLE

For the initiation phase in which the dissolution of trona takes place with water in a pancake-shaped gap with a 600-ft (ca. 183-m) radius and a 0.4-inch (ca. 1-cm) width, with a dissolution rate of 3 $g/m^2/s$, a time period of about 10 minutes would be necessary to obtain a brine containing 15% sodium carbonate from this gap. The calculation results are shown in TABLE 2.

TABLE 2

| | | |
|---|---|---|
| Gap surface area | 125664 | $m^2$ |
| Gap thickness | 0.01 | m |
| Dissolution rate | 3 | $g/m^2/s$ |
| Dissolution rate in the gap | 0.376991 | ton/s |
| Density of 15% $Na_2CO_3$ brine | 1.15 | $ton/m^3$ |
| Weight of the brine in the gap | 1445 | ton |
| Dissolved trona in the gap | 217 | ton |
| Time to reach 15% saturation | 9.6 | min |

This disclosure of all patent applications, and publications cited herein are hereby incorporated by reference, to the extent that they provide exemplary, procedural or other details supplementary to those set forth herein.

Should the disclosure of any of the patents, patent applications, and publications that are incorporated herein by reference conflict with the present specification to the extent that it might render a term unclear, the present specification shall take precedence.

Accordingly, the scope of protection is not limited by the description set out above, but is only limited by the claims which follow, that scope including all equivalents of the subject matter of the claims.

Each and every claim is incorporated into the specification as an embodiment of the present invention. Thus, the claims are a further description and are an addition to the preferred embodiments of the present invention.

While preferred embodiments of this invention have been shown and described, modifications thereof can be made by one skilled in the art without departing from the spirit or teaching of this invention. The embodiments described herein are exemplary only and are not limiting. Many variations and modifications of systems and methods are possible and are within the scope of the invention.

The invention claimed is:

1. In an underground formation containing an evaporite mineral stratum comprising a water-soluble mineral selected from the group consisting of trona, nahcolite, wegscheiderite, and combinations thereof, said mineral stratum lying immediately above a water-insoluble stratum of a different composition, said formation comprising a defined parting interface between the two strata and above which is defined an overburden up to the ground surface, a method of solution mining of said evaporite stratum, comprising an initiation phase which comprises a lifting step (a), a soaking step (b), and an extraction step (c), wherein in step (a), a first solvent is injected at the parting interface to lift the evaporite stratum at a lifting hydraulic pressure greater than the overburden pressure, thereby forming a void at the interface and creating a mineral free-surface which comes in contact with said first solvent, wherein said first solvent comprises water or an unsaturated aqueous solution comprising sodium carbonate, sodium bicarbonate, sodium hydroxide, or combinations thereof;

wherein in step (b), said first solvent is maintained stationary at said hydraulic pressure in the void to contact said mineral free-surface for a time sufficient to dissolve at least a portion of said mineral into said first solvent to form a first brine and a cavity with a new mineral free-surface, wherein said first brine comprises sodium carbonate, sodium bicarbonate, or combinations thereof; and wherein in step (c), at least a portion of said first brine is extracted from underground to the ground surface, and said method further comprising at least one exploitation phase, wherein the exploitation phase comprises a partial filling or filling step (d), a soaking step (e), and an extraction step (f), wherein in step (d), a second solvent is injected into the cavity obtained in step (b) to reach a target hydraulic pressure, wherein the second solvent comprises water or an unsaturated aqueous solution comprising sodium carbonate, sodium bicarbonate, sodium hydroxide, or combinations thereof, wherein the components of said second solvent are the same as or different than the components of said first solvent, wherein the target hydraulic pressure is the same as the lifting hydraulic pressure used in step (a), an intermediate lifting hydraulic pressure less than the lifting hydraulic pressure used in step (a) but greater than a hydrostatic head pressure at the depth at which the cavity is, or equal to or less than a hydrostatic head pressure at the depth at which the cavity is wherein in step (e), said second solvent is maintained stationary at said target hydraulic pressure in the cavity to contact said new mineral free-surface for a time sufficient to dissolve at least a portion of said mineral into said second solvent to form a second brine, wherein said second brine comprises sodium carbonate, sodium bicarbonate, or combinations thereof; and wherein in step (f), at least a portion of said second brine is extracted from underground to the ground surface; and wherein the time for dissolution in step (e) is sufficient to obtain a Total Alkali content in the second brine of at least 8 wt %.

2. The method according to claim 1, wherein the lifting hydraulic pressure applied in step (a) is characterized by a fracture gradient between 0.9 psi/ft (20.4 kPa/m) and 1.5 psi/ft (34 kPa/m).

3. The method according to claim 1, wherein the lifting hydraulic pressure applied in step (a) is from 0.01% to 50% greater than the overburden pressure.

4. The method according to claim 1, wherein the first solvent injected in step (a) comprises water or an aqueous solution, and further comprises particles suspended in water or said aqueous solution.

5. The method according to claim 1, wherein the second solvent injected in step (d) comprises an unsaturated aqueous solution comprising sodium carbonate, sodium bicarbonate, sodium hydroxide, calcium hydroxide, or combinations thereof.

6. The method according to claim 1, wherein the second solvent injected in step (d) comprises at least a portion of the second brine extracted to the surface in step (f).

7. The method according to claim 1, wherein the time sufficient for dissolution in step (b) is from 5 minutes to 72 hours.

8. The method according to claim 7, wherein the dissolution of said mineral in step (b) is for a time sufficient for the cavity created at the interface to have a width of at least 0.5 cm.

9. The method according to claim 1, wherein the first solvent injection in step (a) and the first brine extraction in step (c) are carried out via a single well.

10. The method according to claim 1, wherein the first solvent injection and the first brine extraction are carried out via separate wells which are in fluid communication with the void created in step (a) and/or with the cavity created in the step (b).

11. The method according to claim 1, wherein the parting interface is horizontal or near-horizontal with a dip of 5 degrees or less.

12. The method according to claim 1, wherein the extraction step (c) is carried out by pulling or pushing the brine with a pump or by decreasing the hydraulic pressure.

13. The method according to claim 1, wherein the step (e) is carried out under a target pressure lower than hydrostatic head pressure at the depth at which the cavity is.

14. The method according to claim 1, wherein the step (e) is carried out under a target hydraulic pressure equal to hydrostatic head pressure at the depth at which the cavity is.

15. The method according to claim 1, wherein the step (e) is carried out under a target hydraulic pressure which is the same as the lifting hydraulic pressure used in step (a) or an intermediate lifting hydraulic pressure less than the lifting hydraulic pressure used in step (a) but greater than the hydrostatic head pressure at the depth at which the cavity is.

16. The method according to claim 1, wherein the evaporite mineral stratum comprises trona; wherein the water-insoluble underlying stratum is an oil shale; and wherein the interface between the two strata is at a shallow depth of 3,000 ft (914 m) or less.

17. The method according to claim 1, wherein the method comprising: comprises:

performing the initiation phase with steps (a)-(c); and performing one or more exploitation phases with steps (d)-(f), in which:

when the cavity is not self-supported, the target hydraulic pressure maintained in step (e) is the same lifting hydraulic pressure used in step (a) or is an intermediate lifting hydraulic pressure which is less than that used in step (a) and more than the hydrostatic head pressure at the depth at which the cavity is;

when the cavity is self-supported by a layer of insolubles, the target hydraulic pressure maintained in step (e) is at hydrostatic head pressure; and/or when the cavity is self-supported by mineral rubbles and optionally a layer of insolubles, the target hydraulic pressure maintained in step (e) is at or below hydrostatic head pressure at the depth at which the cavity is.

18. A manufacturing process for making one or more sodium-based products from an evaporite mineral stratum comprising a water-soluble mineral selected from the group consisting of trona, nahcolite, wegscheiderite, and combinations thereof, said process comprising:

carrying out the method of solution mining of the evaporite stratum according to claim 1 to obtain a brine comprising sodium carbonate and/or sodium bicarbonate, and passing at least a portion of said brine through one or more units selected from the group consisting of a crystallizer, a reactor, and an electrodialysis unit, to form at least one sodium-based product.

* * * * *